US011255067B2

(12) United States Patent
Millman

(10) Patent No.: US 11,255,067 B2
(45) Date of Patent: Feb. 22, 2022

(54) COVER DEVICE

(71) Applicant: Steve Millman, Grand Rapids, MI (US)

(72) Inventor: Steve Millman, Grand Rapids, MI (US)

(73) Assignee: Steve Millman, Grand Rapids, MI (US)

( * ) Notice: Subject to any disclaimer, the term of this patent is extended or adjusted under 35 U.S.C. 154(b) by 0 days.

(21) Appl. No.: 16/862,814

(22) Filed: Apr. 30, 2020

(65) Prior Publication Data

US 2020/0370266 A1 Nov. 26, 2020

Related U.S. Application Data

(60) Provisional application No. 62/851,214, filed on May 22, 2019, provisional application No. 62/949,076, filed on Dec. 17, 2019.

(51) Int. Cl.
*E02D 29/14* (2006.01)
*E02D 17/10* (2006.01)

(52) U.S. Cl.
CPC ..... *E02D 29/1427* (2013.01); *E02D 17/10* (2013.01); *E02D 2220/00* (2013.01)

(58) Field of Classification Search
CPC ..... Y10T 292/103; Y10T 292/0894; Y10T 292/0895; E02D 29/14; E02D 29/1427
USPC ..... 70/163, 166–173; 404/25, 26; 52/19–21
See application file for complete search history.

(56) References Cited

U.S. PATENT DOCUMENTS 3,699,730 A * 10/1972 Humphrey ..... F16J 13/02 52/19
5,201,151 A * 4/1993 LeBlanc ..... E02D 29/1427 404/25
5,533,641 A * 7/1996 Argandona ..... B65D 90/105 220/248
5,845,442 A * 12/1998 Strehlow ..... E02D 29/14 52/302.7
5,979,117 A 11/1999 Fuller
6,161,589 A 12/2000 Bolotte et al.
6,309,027 B1 * 10/2001 Smith ..... B60B 7/0053 301/37.109
6,453,603 B1 9/2002 Baker
6,488,440 B1 12/2002 Hill
6,584,734 B2 7/2003 Mihalicz et al.
6,711,921 B1 * 3/2004 Yang ..... E05B 73/0082 248/551
7,797,892 B2 9/2010 Cannistraro et al.
8,689,488 B2 4/2014 Rodrigue et al.

(Continued)

*Primary Examiner* — Sunil Singh
(74) *Attorney, Agent, or Firm* — Price Heneveld LLP

(57) ABSTRACT

A cover device for use with an aperture disposed through a surface and having an inner perimeter surface includes a cover plate having a body portion with inner and outer surfaces and at least one elongated channel disposed therethrough. The cover plate includes a plurality of retention members extending inwardly into the at least one elongated channel. At least one engagement feature is operably coupled to the cover plate at the at least one elongated channel and slidably disposed along the at least one elongated channel between retracted and deployed positions. The at least one engagement feature includes at least one engagement member disposed below the inner surface of the cover plate that engages the inner perimeter surface of the aperture when the at least one engagement feature is in the deployed position when the cover plate is positioned over the aperture.

16 Claims, 20 Drawing Sheets

(56) References Cited

U.S. PATENT DOCUMENTS

| | | | | |
|---|---|---|---|---|
| 2003/0026940 | A1* | 2/2003 | Bullock | B44C 5/04<br>428/99 |
| 2008/0075532 | A1 | 3/2008 | Boyd | |
| 2008/0314902 | A1 | 12/2008 | Dayton et al. | |
| 2009/0178823 | A1* | 7/2009 | Pinkowski | H02G 3/14<br>174/66 |
| 2014/0041311 | A1 | 2/2014 | Auckland | |

* cited by examiner

COVER DEVICE

FIELD

The present device generally relates to a cover device for covering open apertures, and more specifically, to a cover device having a cover plate and an engagement feature for selectively engaging the contours of an open aperture for securing the cover plate over an opening of the aperture.

BACKGROUND

In various construction projects, concrete is poured to define floors of a building. Such a construction project may include a number of floors comprised of concrete slab floor surfaces. Interconnecting utilities, such as plumbing, electrical and the like, between adjacent floors requires boring holes through the concrete. Such holes can be cut in concrete using any number of techniques, such as coring with a coring barrel. The resulting hole or aperture may be present in the concrete slab for periods of time during the construction project. Before utilities, pipes, or other structures are positioned in the apertures, the open apertures must be covered in order to provide a safe and compliant jobsite. Presently known aperture covers are generally comprised of a flat wood piece (such as plywood) sufficiently sized to cover the hole, wherein a block of wood is generally fastened to an underside of the plywood and is received in the hole when the hole is covered by the plywood. Such a cover device is prone to movement as the block of wood fastened to the underside of the plywood does not consistently engage the contours of the hole, but rather is set in-place member used to keep the plywood from shifting laterally. Further, such cover devices can be a tripping hazard. Thus, a cover device that can be easily installed using engaging retention features is desired.

SUMMARY

In at least one aspect, a cover device is provided for use with an aperture disposed through a surface and having an inner perimeter surface. The cover device includes a cover plate having at least one elongated channel with a first end and a second end. The cover plate further includes a first plurality of retention members extending from the cover plate adjacent to a first side of the at least one elongated channel and a second plurality of retention members extending from the cover plate adjacent to a second side of the at least one elongated channel. A retainer mechanism is operably coupled to the cover plate. The retainer mechanism includes at least one engagement feature operable between retracted and deployed positions. The at least one of the engagement feature engages the inner perimeter surface of the aperture in the deployed position when the cover plate is positioned over the aperture.

In at least another aspect, a cover device for use with an aperture disposed through a surface and having an inner perimeter surface includes a cover plate having a body portion with inner and outer surfaces and at least one elongated channel disposed therethrough. The cover plate includes a plurality of retention members extending inwardly into the at least one elongated channel. At least one engagement feature is operably coupled to the cover plate at the at least one elongated channel and slidably disposed along the at least one elongated channel between retracted and deployed positions. The at least one engagement feature includes at least one engagement member disposed below the inner surface of the cover plate that engages the inner perimeter surface of the aperture when the at least one engagement feature is in the deployed position when the cover plate is positioned over the aperture.

In at least another aspect, a cover device includes a cover plate having a body portion with inner and outer surfaces and a channel disposed therethrough. An engagement feature is slidably disposed within the channel between deployed and retracted positions. The engagement feature includes a slider at least partially positioned above the channel and an engagement member positioned below the channel.

In at least another aspect, a cover plate includes a body portion with inner and outer surfaces and first and second elongated channels disposed therethrough. A first engagement feature is slidably disposed within the first elongated channel between first and second positions. A second engagement feature is slidably disposed within the second elongated channel between first and second positions.

These and other features, advantages, and objects of the present device will be further understood and appreciated by those skilled in the art upon studying the following specification, claims, and appended drawings.

DETAILED DESCRIPTION OF EMBODIMENTS

Figure 1:
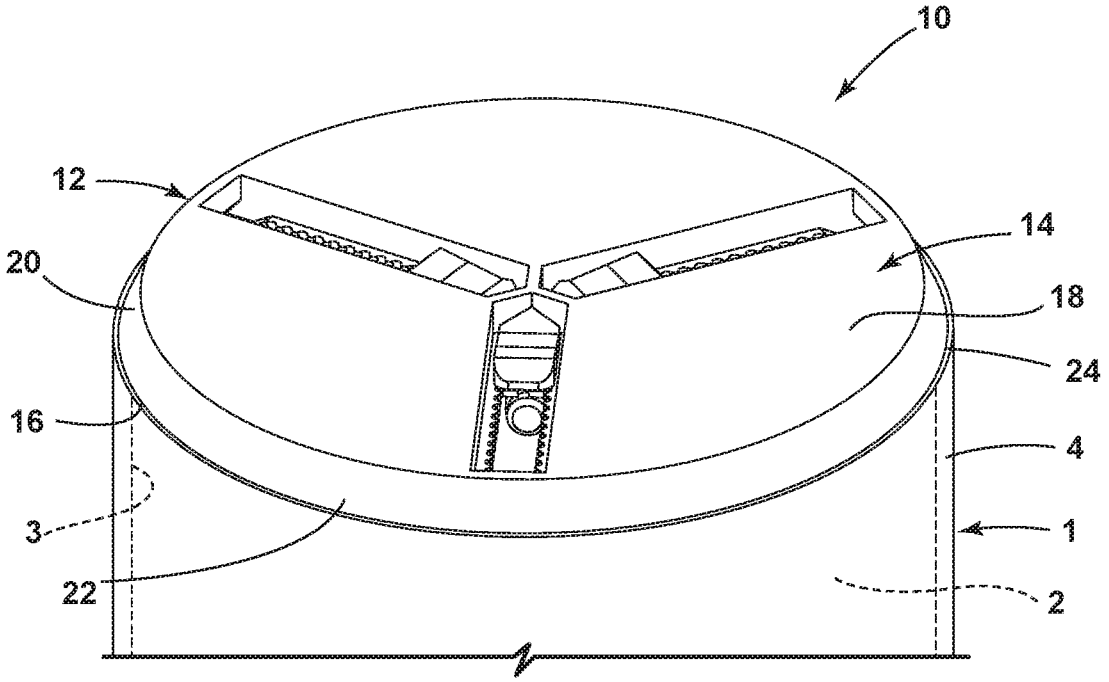
FIG. 1 is a top perspective view of a cover device positioned on a structure having an aperture.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIG. 1, reference numeral 10 generally designates a cover device for covering an aperture 1. In the embodiment shown in FIG. 1, the aperture 1 includes a cavity or receiving well 2 having an inner perimeter surface 3. While the aperture 1 shown in FIG. 1 generally includes a sidewall 4, it is contemplated that the aperture 1 may be positioned through a concrete slab used as a floor (or other like support surface) in a construction project, wherein the receiving well or cavity 2 is disposed through the concrete slab. Thus, the aperture 1 as depicted in FIG. 1 is exemplary only, and the features which comprise the aperture 1 are exemplary of an aperture designed to be covered by the present cover device 10. The aperture 1 may have any shape, or could be a combination of numerous adjacent cored holes. The aperture 1 is shown in FIG. 1 as a round aperture. For purposes of this disclosure, the aperture 1 is illustrated as a round aperture, but is not meant to limit the scope of the present concept in any way.

As further shown in FIG. 1, the cover device 10 includes a cover plate 12 having a body portion 14 with inner and outer surfaces 16, 18 which are interconnected by a surrounding side portion 20. In the embodiment shown in FIG. 1, the inner and outer surfaces 16, 18 are interconnected by the side portion 20, which is disposed in a tapered relationship between the inner surface 16 and outer surface 18 to provide a beveled edge 22 surrounding the cover plate 12 along an outer perimeter 24 thereof. In the embodiment shown in FIG. 1, the cover plate 12 is a round cover plate positioned over a round aperture 1. However, it is contemplated that the cover plate 12 may include a variety of configurations necessary to cover the aperture 1. As explained above, the aperture 1 may include a round aperture or a combination of round apertures. Further, the aperture 1 may include any other shape configuration positioned through a support surface that needs to be covered. As such, the cover plate 12 may include a variety of configurations beyond the disk-shaped cover plate 12, as shown in FIG. 1. Further, the cover plate 12 may be much greater in size as compared to the overall size of the aperture 1. The beveled edge 22 surrounds the side portion 20 of the cover plate 12, such that the cover device 10 is less of an obstruction when placed over an aperture on a floor surface as compared to a section of plywood having a blunt 90-degree edge. The beveled edge 22 also allows for easy clean up around a jobsite when sweeping a floor surface on which the cover device 10 is positioned. The beveled edge 22 may be a rounded or chamfered edge (such as shown in FIGS. 23-26) or a straight angled edge. The cover plate 12 may include a color (such as a construction orange color) to provide a visible cautionary feature to workers on a jobsite.

Figure 2:
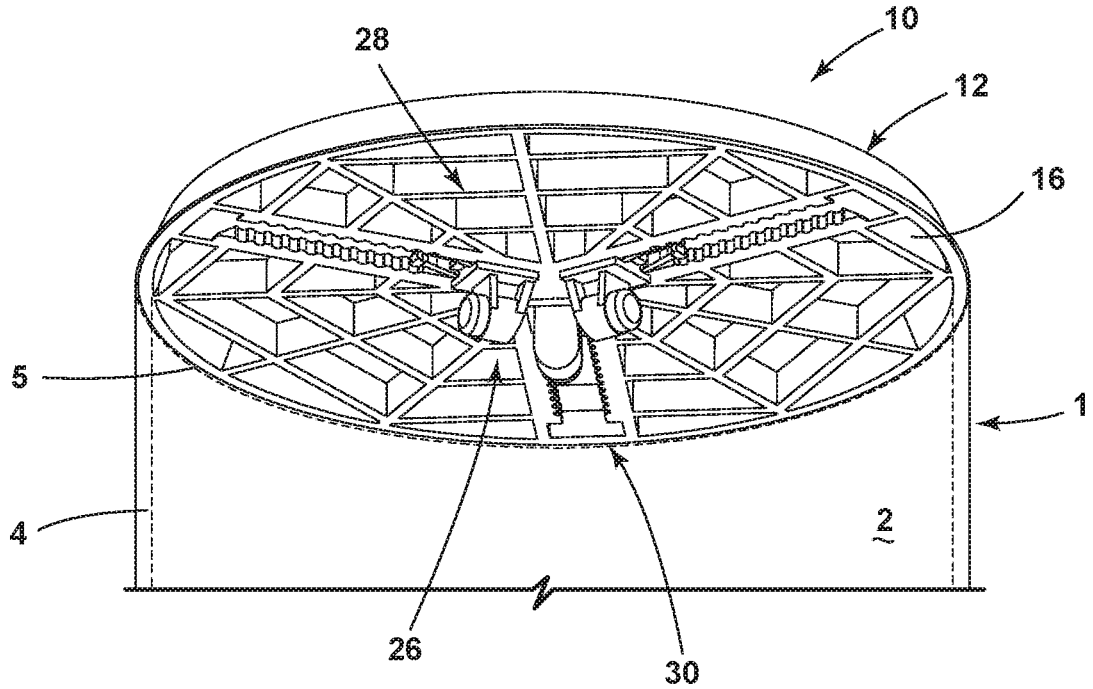
FIG. 2 is a bottom perspective view of the cover device of FIG. 1 with portions of the structure having the aperture shown in phantom.

Referring now to FIG. 2, the cover plate 12 of the cover device 10 is shown from a bottom perspective view positioned on the aperture 1, wherein the inner surface 16 of the cover plate 12 is shown positioned beyond an opening 5 into the receiving well 2 of the aperture 1. In this way, the cover plate 12 is properly sized to cover the entire opening 5 of the aperture 1, such that no portion of the receiving well 2 of the aperture 1 is exposed. It is also contemplated that the cover plate 12 may extend past the sidewall 4 of the aperture without departing from the teachings herein. In the embodiment of FIG. 2, a portion of the sidewall 4 of the aperture 1 is shown in a transparent manner to reveal a retainer mechanism 26. The specific portions of the retainer mechanism 26 and the function thereof are further described below.

As illustrated in FIG. 2, the inner surface 16 defines a plurality of ribs 28. The plurality of ribs 28 may extend across the inner surface 16 in a pattern and/or at regular intervals. It is also contemplated that the plurality of ribs 28 may be disposed at irregular intervals or disposed randomly across the inner surface 16. As further shown in the embodiment of FIG. 2, the plurality of ribs 28 are disposed in a repeated pattern of expanding polygonal shapes interrupted by a plurality of elongated channels 30 defined by the inner surface 16 of the cover plate 12. The plurality of ribs 28 may be advantageous for providing support to the cover device 10. Further, the plurality of ribs 28 may be advantageous for decreasing costs of materials for the cover device 10.

Figure 3:
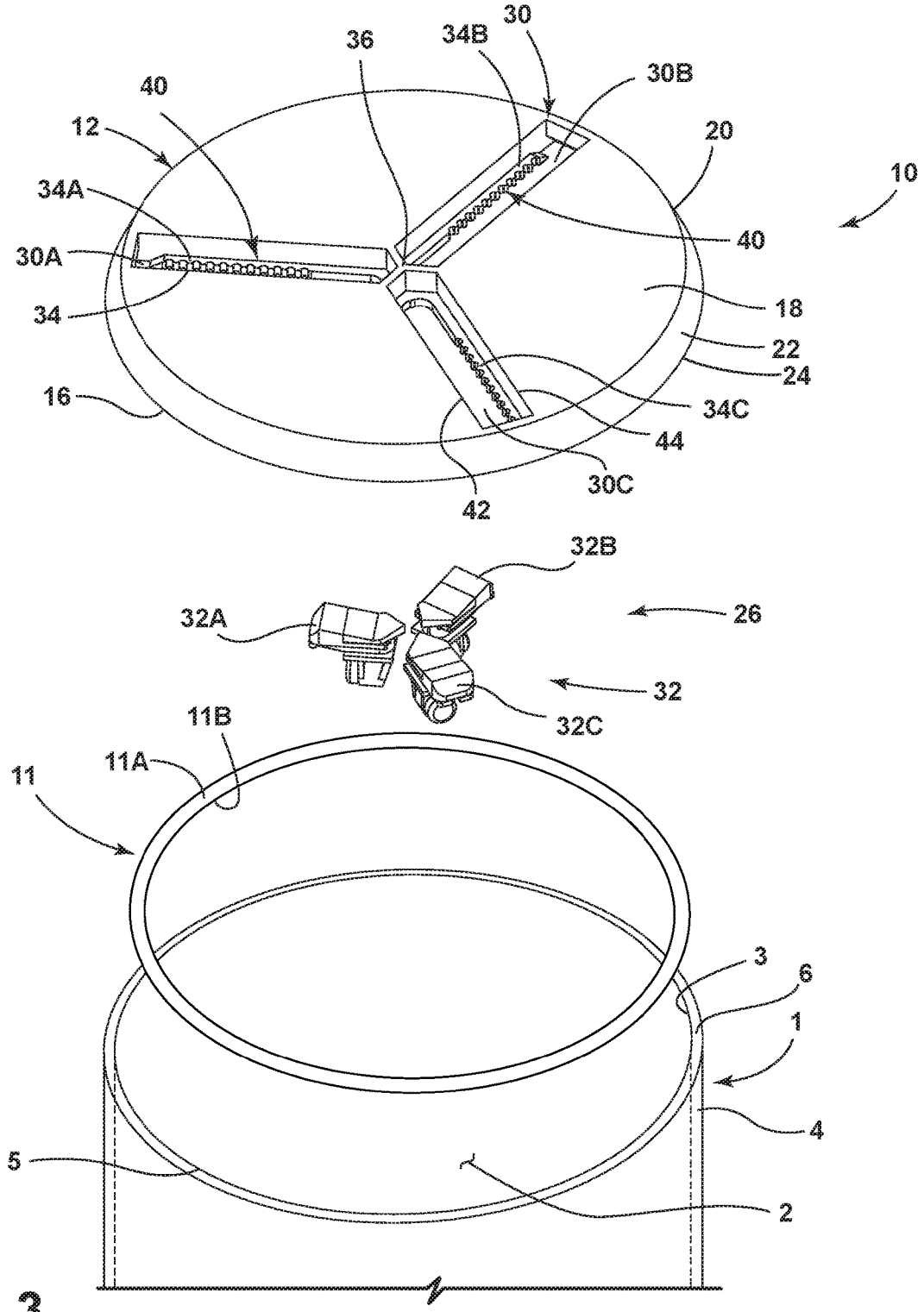
FIG. 3 is an exploded top perspective view of the cover device of FIG. 1 showing the components of the cover device exploded away from the aperture.

Referring now to FIG. 3, the cover device 10 is shown in an exploded top perspective view. The retainer mechanism 26 includes a plurality of engagement features 32, which is comprised of individual engagement features 32A-32C. The outer surface 18 of the cover plate 12 defines a plurality of recesses 34, comprised of individual recesses 34A-34C. The recesses 34A-34C extend radially outward from a center portion 36 of the cover plate 12 outward towards the beveled edge 22 and/or the side portion 20 of the cover plate 12. The cover device 10 includes the plurality of elongated channels 30, comprised of individual elongated channels 30A-30C that are disposed through the cover plate 12. The elongated channels 30A-30C may each be defined within one of the individual recesses 34A-34C, respectively. Much like the recesses 34A-34C, the elongated channels 30A-30C extend radially outward from the center portion 36 of the cover plate 12 outward towards the beveled edge 22 and/or the side portion 20 of the cover plate 12. A different configuration and/or arrangement of the recesses 34A-34C and/or the elongated channels 30A-30C is also contemplated without departing from the teachings herein. As further shown in FIG. 3, a seal member 11 is exploded away from the inner surface 16 of the cover device 10. The seal member 11 is configured to abut the inner surface 16 of the cover plate 12 when the cover device 10 is positioned over an aperture. Specifically, the seal member 11 includes an upper side 11A which abuts the inner surface 16 of the cover plate 12. The seal member 11 may be coupled to the cover plate 12 at the inner surface 16 thereof, or may be a removable part of the cover device 10. The seal member 11 further includes a lower side 11B which is configured to abut an upper surface 6 of a support surface in which the aperture 1 is disposed. For instance, if the aperture 1 is disposed through a floor, the entire upper surface of the floor defines the upper surface 6. As the cover device 10 is configured to engage an upper surface surrounding an aperture, the lower side 11B of the seal member 11 abuts the upper surface 6 when the cover device 10 covers aperture 1. In this way, the cover device 10 of the present concept can provide for a leak-proof seal over an aperture. It is contemplated that the seal member 11 include any configuration suitable to surround an aperture at an upper surface thereof, and is not limited to the ring-shaped seal member 11 shown in FIG. 3.

Figure 4:
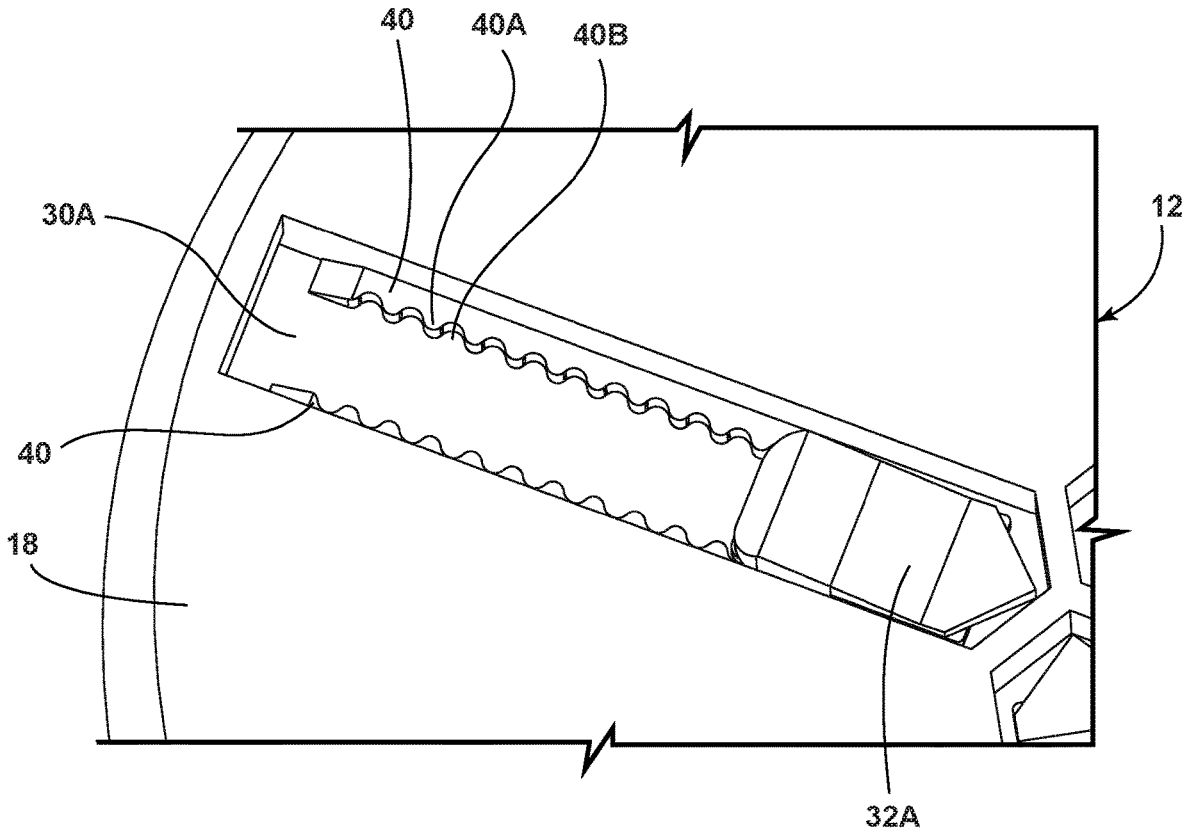

Referring to FIGS. 3 and 4, in various examples, the outer surface 18 of the cover plate 12 defines the recesses 34A-34C, and the inner surface 16 of the cover plate 12 defines the elongated channels 30A-30C. Similar to the recesses 34A-34C, the elongated channels 30A-30C may extend radially outwards from the center portion 36 of the cover plate 12 towards the beveled edge 22 and/or side portion 20. The inner surface 16 of the cover plate 12 includes retention members 40 disposed adjacent to a first side 42 of each of the individual elongated channels 30A-30C. Additionally, the inner surface 16 includes the retention members 40 disposed adjacent to a second opposing side 44 of each individual elongated channel 30A-30C. The retention members 40 each define alternating outward projections 40A and inward recesses 40B. The outward projections 40A may extend into the elongated channels 30A-30C, whereas the inward recesses 40B may extend away therefrom. The outward projections 40A and inward recesses 40B may provide for a generally sinusoidal, continuous surface. Further, the outward projections 40A and inward recesses 40B provide for the deployed, retracted, and intermediate positions for the engagement features 32A-32C. As illustrated in FIG. 3, the cover plate 12 includes a plurality of outward projections 40A and inward recesses 40B adjacent to the first side 42 of the elongated channels 30A-30C and a plurality of outward projections 40A and inward recesses 40B adjacent to the second opposing side 44 of the elongated channels 30A-30C, respectively. Accordingly, the retention members 40 extend inwardly into the elongated channels 30A-30C from both the first and second sides 42, 44 towards one another. The retention members 40 align to provide dual-sided tracks along which the engagement features 32A-32C are slidably engaged and selectively retained. For example, the retention members 40 are configured to retain the engagement features 32A-32C in the retracted and deployed positions along the elongated channels 30A-30C. Further, the retention members 40 provide at least one intermediate position disposed between the deployed and retracted positions for the engagement features 32A-32C. In the embodiment illustrated in FIG. 3, the retention members 40 provide a plurality of intermediate positions for the engagement features 32A-32C. The intermediate positions may be advantageous for securing the cover device 10 to apertures of various sizes. Further, the intermediate positions may allow for a single cover device 10 to be used to cover apertures of differing sizes.

With reference to FIGS. 3-6, the engagement features 32A-32C are contemplated to be operable between deployed and retracted positions along the elongated channels 30A-30C. Specifically, the engagement features 32A-32C are slidable between a first end 48 of the elongated channels 30A-30C and a second end 50 of the elongated channels 30A-30C, respectively. The first ends 48 of the elongated channels 30A-30C may correspond with the retracted positions of the engagement features 32A-32C, as the first ends 48 of the elongated channels 30A-30C are positioned proximate the center portion 36 of the cover plate 12 in assembly. Additionally, the second ends 50 of the elongated channels 30A-30C may correspond with the deployed positions of the engagement features 32A-32C, as the second ends 50 of the elongated channels 30A-30C are positioned proximate the side portion 20 of the cover plate 12.

Additionally or alternatively, the engagement features 32A-32C each include a slider 52. The sliders 52 may be disposed at least partially within the recesses 34A-34C defined by the outer surface 18 of the cover plate 12. In various examples, the sliders 52 may be disposed entirely within the recesses 34A-34C, respectively. A top 54 of the sliders 52 may include a first angled surface 54A and a second angled surface 54B that are angled towards one another to define a depression 56 for a user to move the engagement features 32A-32C along the elongated channels 30A-30C between the retracted and deployed positions. The depression 56 may provide a location for a user to press down and/or to laterally move the engagement features 32A-32C along the elongated channels 30A-30C. Stated differently, the top 54 of the sliders 52 of the engagement features 32A-32C may provide an interface for moving the engagement features 32A-32C along the elongated channels 30A-30C. Accordingly, the engagement features 32A-32C may be slidably engaged or slidably coupled with the elongated channels 30A-30C and may be moved along the elongated channels 30A-30C in response to force applied by the user. The force may be a generally downward force and/or a lateral force directed towards a desired position for the engagement features 32A-32C (e.g., deployed or retracted). The top 54 of the sliders may also be textured for better grip and/or engagement by a user.

Figure 5:
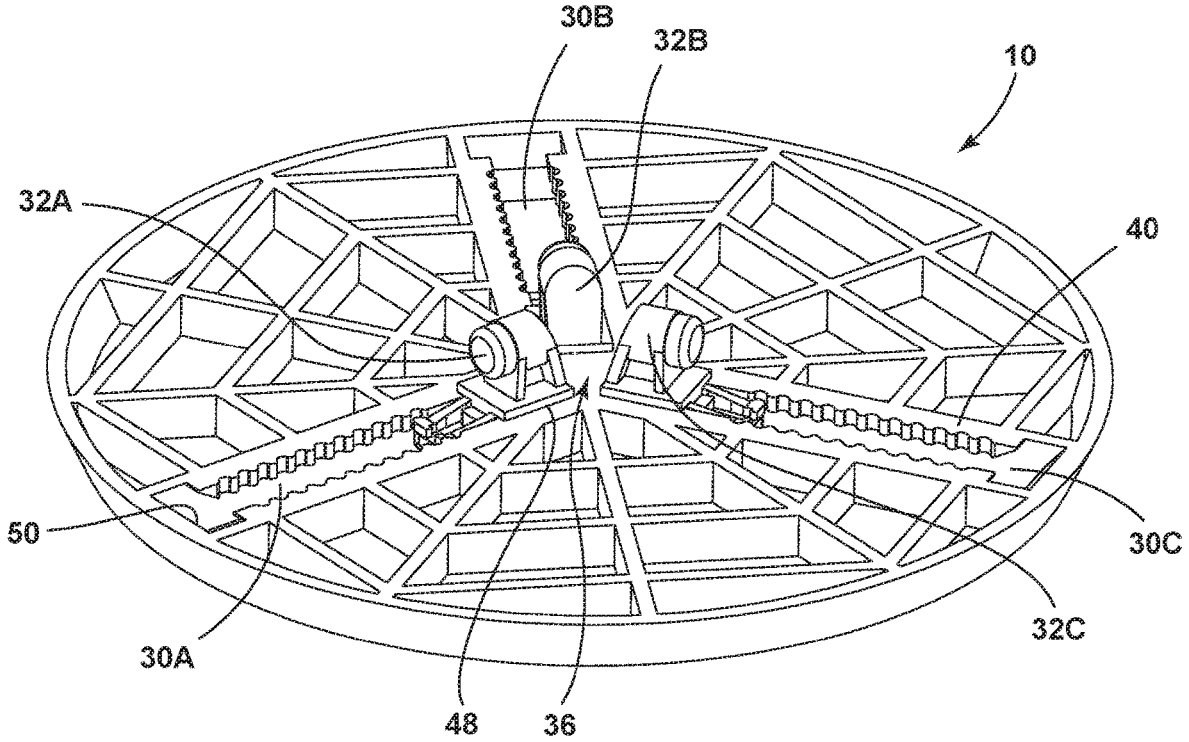
FIG. 5 is a bottom perspective view of the cover device of FIG. 1.
Figure 6:
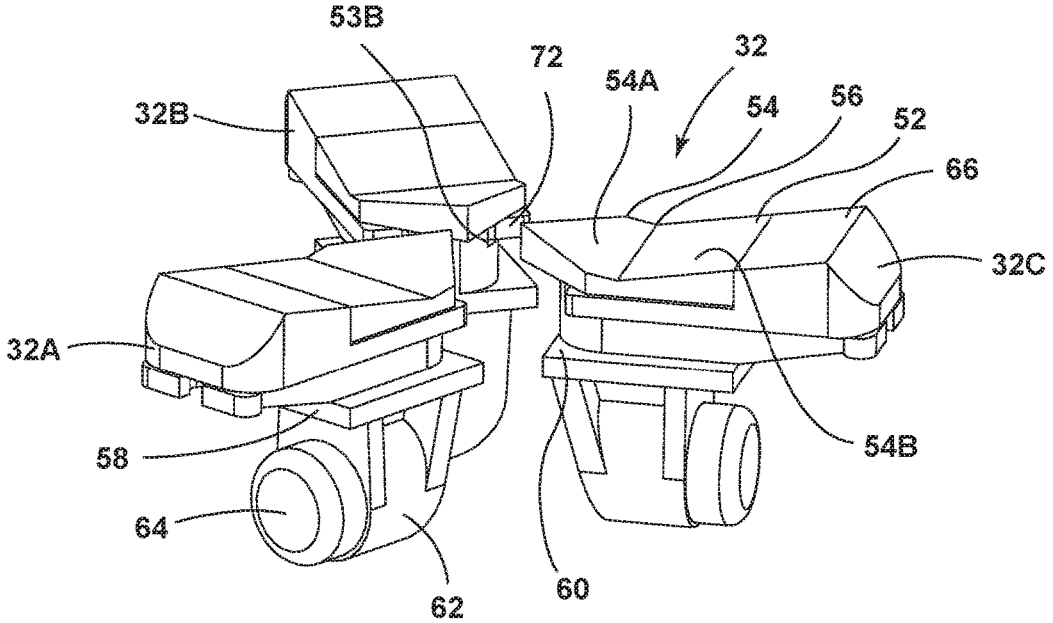
FIG. 6 is an enlarged side perspective view of engagement features of the cover device of FIG. 1 with a cover plate of the cover device removed.
Figure 7:
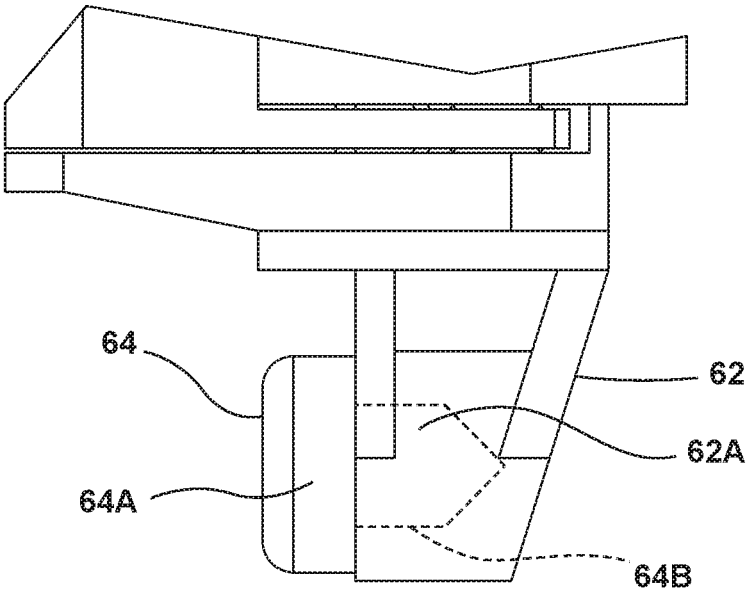
FIG. 7 is side perspective view of an engagement feature with portions of the engagement feature shown in phantom.

With further reference to FIGS. 5-7, engagement features 32A-32C may include lower plates 58 spaced-apart from the sliders 52 by an insert portion or groove 60 defined therebetween. The groove 60 allows the engagement features 32A-32C to be slidably engaged with the elongated channels 30A-30C. As such, the retention members 40 extend into the groove 60 when the engagement features 32A-32C are positioned within the elongated channels 30A-30C, but still allow the engagement features 32A-32C to move between the deployed and retracted positions along the elongated channels 30A-30C. Each of the engagement features 32A-32C also include a support 62 extending vertically downwards from the lower plate 58 and having an engagement member 64 coupled thereto. The engagement members 64 include a head portion 64A and a stem portion 64B. The supports 62 define channels 62A for receiving the stem portions 64B of the engagement members 64. The head portions 64A of the engagement members 64 may abut a surface surrounding the channels 62A. In various examples, the engagement members 64 may be removable and/or replaceable components. The engagement members 64 may be retained within the channels 62A via adhesives or other coupling devices. Further, the stem portions 64B of the engagement members 64 may be retrained in the channels 62A via form-fitting connections. The engagement members 64 are disposed below the inner surface 16 of the cover plate 12 and are configured to be received within the receiving well 2 of the aperture 1 to engage the inner perimeter surface 3 of the aperture 1 when the engagement features 32A-32C are moved outwardly to an engaged or deployed position relative to the aperture 1. Accordingly, the engagement members 64 may wear before other components of the cover device 10. As such, it may be advantageous to include removable engagement members 64 to provide for easier replacement of worn parts. Further, the engagement members 64 may be resiliently and/or elastically deformable, such that the engagement members 64 may compress against the sidewall 4 of the aperture 1 when the engagement features 32A-32C are in the engaged position. When the engagement features 32A-32C return to the retracted position or an intermediate position spaced-apart from the sidewall 4, the engagement members 64 may return to an original shape. Alternatively, the engagement members 64 may not be elastically or resiliently deformable. In such examples, the engagement members 64 may abut the inner perimeter surface 3 of the sidewall 4 when the engagement features 32A-32C are in the engaged position. The engagement members 64 may be advantageous to securing the cover device 10 to an aperture 1 through contact with the inner perimeter surface 3 of the aperture 1. The engagement member 64 spaced-apart from the sliders 52 may be advantageous to engage the sidewall 4 of the aperture 1 without interference from the sliders 52. Further, the sliders 52 may mbe configured to extend past the inner perimeter surface 3 of the sidewall 4 of the aperture 1 to allow the engagement members 64 to sufficiently engage the sidewall 4. As a deformable member, the head portions 64A of the engagement members 64 may deform upon contact under sufficient pressure with the inner perimeter surface 3 of the aperture 1.

Figure 8:
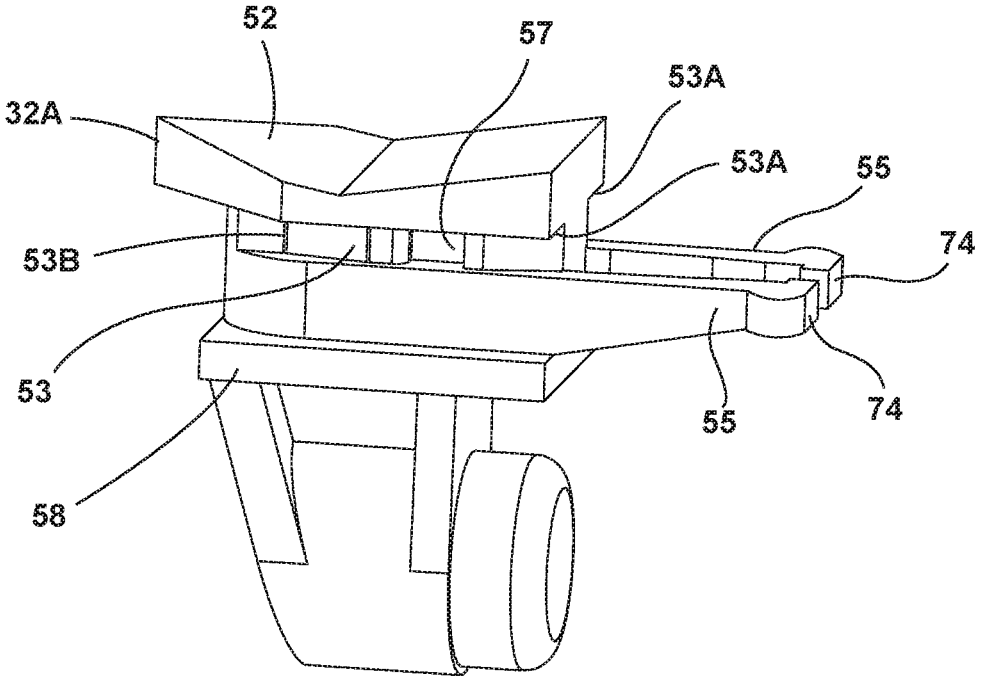
FIG. 8 is a partial side perspective view of an engagement feature with a locking assembly removed.
Figure 10:
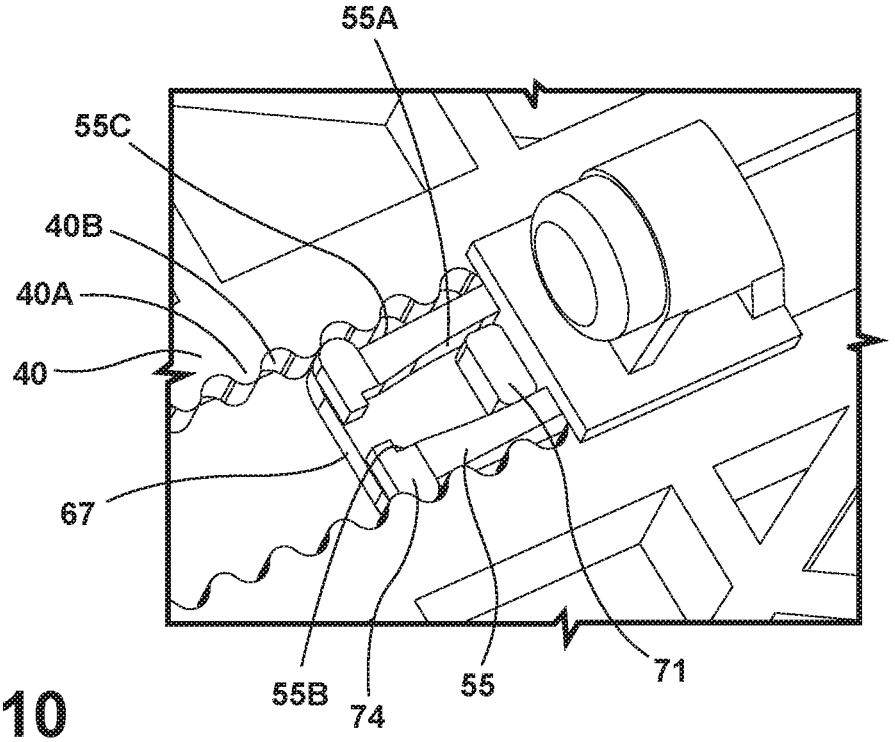
FIG. 10 is a bottom perspective view an engagement feature of a cover device.

With reference to FIG. 8, the engagement feature 32A is illustrated with the slider 52 and without a locking mechanism 66. It is understood that each of the engagement features 32A-32C may be constructed and operated similarly. In various examples, the slider 52 further includes a base 53 and spring fingers 55. The base 53 rests upon the lower plate 58 and includes opposing sidewalls 53A, which include detents 57 on opposed sides of the base 53. The spring fingers 55 are disposed adjacent to the opposing sidewalls 53A of the base 53 and are also disposed adjacent to the lower plate 58. In various examples, the spring fingers 55 may rest upon the lower plate 58, but in other examples the spring fingers 55 may be spaced-apart from the lower plate 58. The spring fingers 55 may be disposed above or below the detents 57, such that the spring fingers 55 may not prevent access to the detents 57. As best shown in FIG. 10, the spring fingers 55 have tapered sides 55A and opposing outer sides 55C. The spring fingers 55 may also include abutment notches 55B proximate outward protrusions 74, which extend away from the opposing spring finger 55. Due to the tapered sides 55A, the width of the spring fingers 55 may increase from proximate the base 53 to proximate the abutment notches 55B. Additionally or alternatively, as illustrated in FIG. 10, the outward protrusions 74 may be rounded, such that the outward protrusions 74 may be slidably engaged with the outward projections 40A and inward recesses 40B of the elongated channels 30A-30C. Further, the outward projections 40A and inward recesses 40B may also have rounded edges to facilitate the sliding of the outward protrusions 74 along the retention members 40 as the engagement features 32A-32C move along the elongated channels 30A-30C as best shown in FIG. 4. Specifically, as shown in FIG. 10, the retention members 40 form a sinusoidal wave pattern along the elongated channels 30A-30C. In various examples, the spring fingers 55 may flex inwards towards one another as the engagement features 32A-32C move along the elongated channels 30A-30C. The inward flexion may allow the outward protrusions 74 and outer sides 55C to shift in response to contact with the outward projections 40A and the inward recesses 40B, while the engagement features 32A-32C move along the elongated channels 30A-30C. As such, the spring fingers 55 are contemplated to be flexibly resilient. Additionally or alternatively, the spring fingers 55 may be biased, such that the outward protrusions 74 may contact and/or travel along the retention members 40, without retaining the engagement features 32A-32C is a specified position. The spring fingers 55 are shown in FIG. 8 as being spaced-apart and mirrored configurations of one another, such that the outward protrusions 74 of the spring fingers 55 are outwardly disposed in opposed directions for engagement with the retention members 40 disposed on opposed sides 42, 44 of the elongated channels 30A-30C. In this way, the spring fingers 55 retain the engagement features 32A-32C at select positons along the elongated channels 30A-30C.

Figure 9:
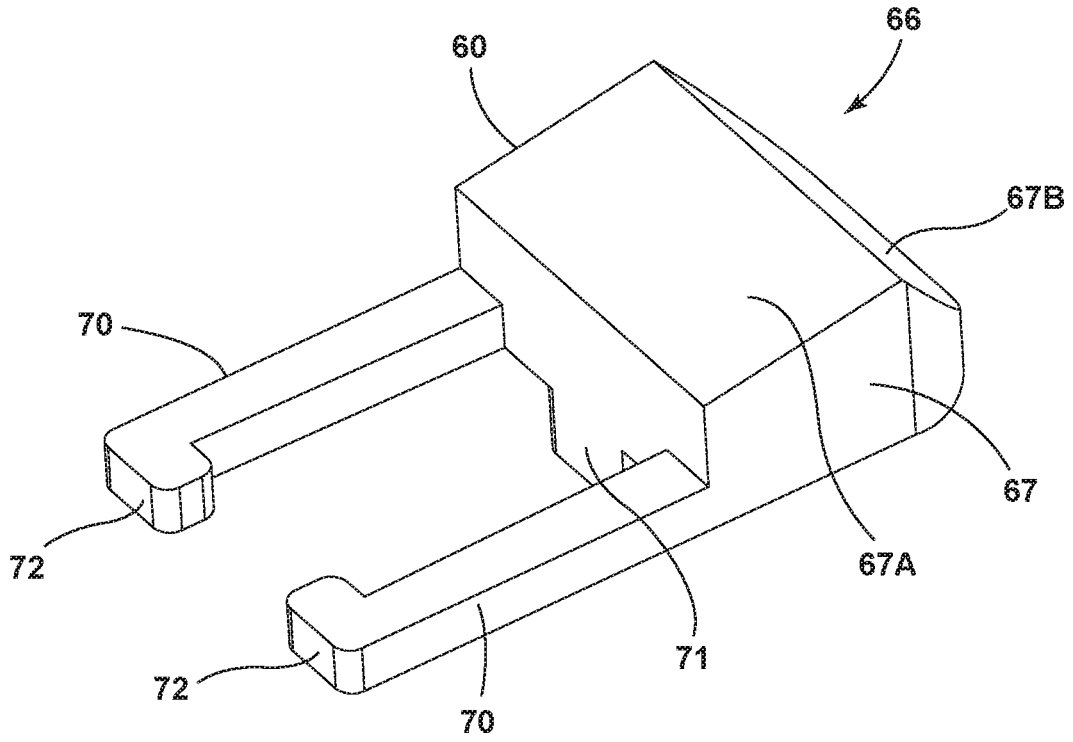
FIG. 9 is a top perspective view of a locking mechanism for an engagement feature.

Referring now to FIG. 9, the locking mechanism 66 is shown having a grip portion 67, a retention block 71, and arms 70 having inward protrusions 72. The grip portion 67 includes a first inclined surface 67A for a user to grip and/or engage the grip portion 67. The first inclined surface 67A may be an extension of the second angled surface 54A of the top 54 of the sliders 52. The grip portion 67 may also have a second inclined surface 67B, having a different or opposed incline than the first inclined surface 67A. The second inclined surface 67B may be advantageous for a user to press and/or push the engagement feature 32A-32C in a desired direction along the elongated channels 30A-30C. The first and second inclined surfaces 67A, 67B may also be textured to increase the grip and/or engagement of the user. Additionally, the arms 70 extend laterally outward from the grip portion 67 and the retention block 71 extends vertically downwards from the grip portion 67 therebetween. The inward protrusions 72 of the arms 70 extend inward towards the opposing arm 70. The inward protrusions 72 may also selectively engage the detents 57, shown in FIG. 8, of the slider 52 when the locking mechanism 66 is in a locked position illustrated in FIGS. 11 and 12. Accordingly, the arms 70 of the locking mechanism 66 may be slidably engaged with a top surface of the spring fingers 55 of the slider 52 to move between the locked and unlocked positions. The base 53 of the slider 52 further includes abutment portions 53B disposed adjacent to the opposing sidewalls 53A. When in the unlocked position, the inward protrusions 72 may engage the abutment portions 53B.

Figure 11:
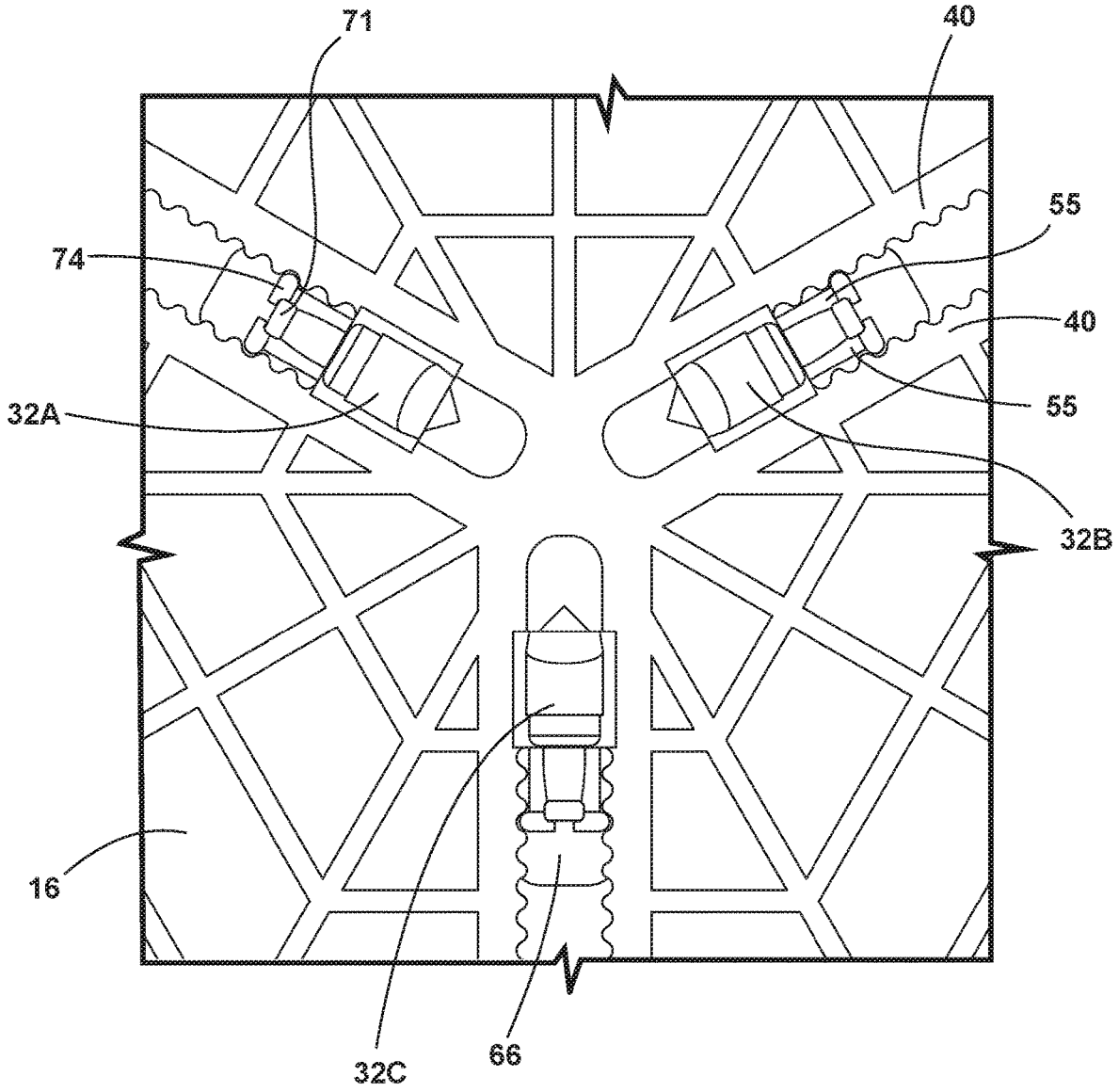
FIG. 11 is a partial bottom perspective view of the cover device of FIG. 1 showing the engagement features of the retainer mechanism in a locked position.
Figure 12:
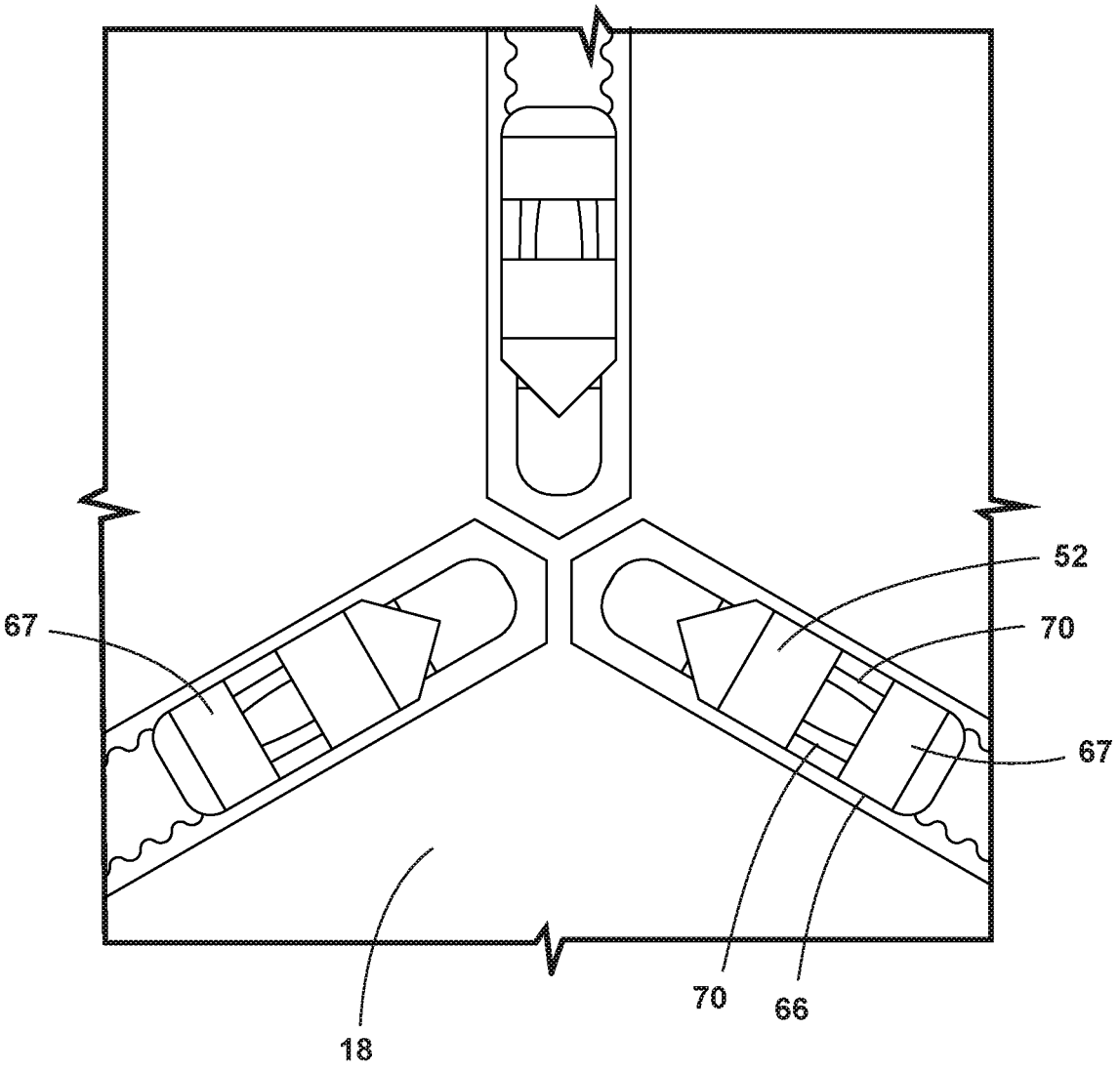
FIG. 12 is a partial top perspective view of the cover device of FIG. 1 showing the engagement features of the retainer mechanism in a locked position.
Figure 13:
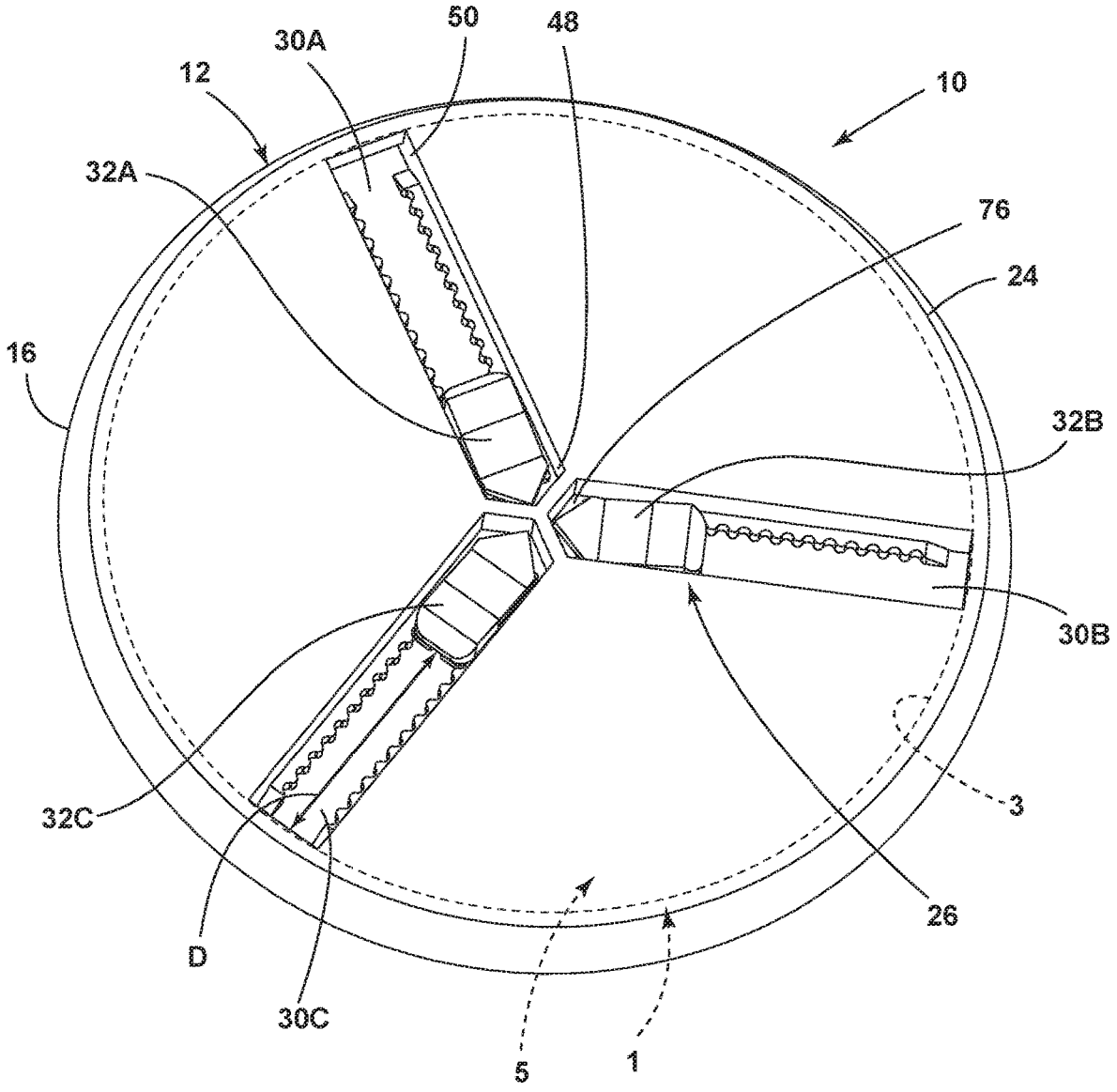
FIG. 13 is a top perspective view of the cover device of FIG. 1 showing the engagement features of the retainer mechanism in a retracted position.

The engagement features 32A-32C are operable between the locked position, as illustrated in FIGS. 11 and 12, and the unlocked position, as illustrated in FIG. 13. The locking mechanism 66 is slidably engaged with the slider 52, such that the locking mechanism 66 may shift forwards and backwards relative to the slider 52 to move between the locked and unlocked positions. In the unlocked position, as illustrated in FIG. 13, the engagement features 32A-32C are configured to slide along the elongated channels 32A-32C. The grip portion 67 abuts the slider 52, and the inward protrusions 72 are disposed adjacent to the abutment portions 53B of the sliders 52. Additionally, the retention block 71 extends between the spring fingers 55 of the slider 52, as best shown in FIG.10. The retention block 71 engages the tapered sides 55A of the spring fingers 55 proximate the base 53.

As the locking mechanism 66 moves to the locked position illustrated in FIGS. 11 and 12, the grip portion 67 separates from the slider 52. As the grip portion 67 moves, the retention block 71 moves along tapered sides 55A of the spring fingers 55 towards the abutment notches 55B. The tapered sides 55A may facilitate smoother and/or easier movement of the retention block 71 along the spring fingers 55. The grip portion 67 and the retention block 71 move until the retention block 71 abuts the abutment notches 55B of the spring fingers 55. The retention block 71 operates to widen the distance between the spring fingers 55 by engaging the tapered sides 55A of the spring finger 55. When the locking mechanism 66 is in the locked position and the retention block 71 abuts the abutment notches 55B, the inward protrusions 72 (FIG. 9) may be disposed within the detents 57 (FIG. 8) of the slider 52. Accordingly, the retention block 71 may prevent the inward flexion of the spring fingers 55. In doing so, the spring fingers 55 are spaced-apart, such that the outer sides 55C engage the outward projections 40A and the outward protrusions 74 engage an inward recesses 40B of the retention members 40 between adjacent outward projections 40A. Accordingly, the retention block 71 engaging the tapered sides 55A proximate the abutment notches 55B and retains the engagement features 32A-32C in a desired position (e.g., deployed, retracted, or engaged positions). Further, when in the locked position, the inward protrusions 72 may be engaged with the detents 57 of the slider 52, which retains the locking mechanism 66 in the locked position, which may be overcome by a user applying direct and intended force on the locking mechanism 66 towards the unlocked position. In this way, the locking mechanism retains the engagement features 32A-32C at select positons along the elongated channels 30A-30C when in the locked position.

In operation, the engagement features 32A-32C may be retained in a selected position via the locking mechanism 66. The engagement features 32A-32C may be moved along the elongated channels 30A-30C when the locking mechanisms 66 are in the unlocked positions. A user may contact the first and second angled surfaces 54A, 54B, of the slider 52 or the second inclined surface 67B of the locking mechanism 66 to move the engagement features 32A-32C which may provide an increased grip for the user. When the engagement features 32A-32C are in the desired position along the elongated channels 30A-30C, a user may contact the inclined surface 67A of the grip portion 67 of the locking mechanism 66 to move the locking mechanism 66 relative to the slider 52. In this way, the user may separate the grip portion 67 from the slider 52 until the inward protrusions 72 engage the detents 57 of the sliders 52. As the user moves the locking mechanism 66, the retention blocks 71 travels along the tapered sides 55A of the spring fingers 55 towards the abutment notches 55B to further separate the spring fingers 55. The outward protrusions 74 of the spring fingers 55 may engage the retention members 40 for retaining the engagement features 32A-32C in the selected position. To once again move the engagement features 32A-32C, the user may contact the grip portion 67 and move the grip portion 67 towards the slider 52. In doing so, the retention block 71 travels along the tapered sides 55A away from the abutment notches 55B, causing the spring fingers 55 to move inward away from the retention members 40. The user may then slide the engagement features 32A-32C along the elongated channels 30A-30C.

Referring to FIG. 13, when the engagement features 32A-32C are in the retracted position proximate the first ends 48 of the elongated channels 30A-30C, respectively, the inward protrusions 72 of the locking mechanisms 66 may abut first end surfaces 76 of the elongated channels 30A-30C. Accordingly, the inward protrusions 72 may prevent the engagement features 32A-32C from moving further towards the first end 48 of the elongated channels 30A-30C once the engagement features 32A-32C reach a predefined location of the elongated channels 30A-30C. The outward protrusions 74 extend outwards from the arms 70 to engage with the retention members 40, as illustrated in FIG. 11. The outward protrusions 74 may be disposed between adjacent outward projections 40A of the retention members 40 adjacent to the first and second sides 42, 44 of the elongated channels 30A-30C to retain the engagement features 32A-32C within a selected position (e.g., one of the retracted, deployed, and/or intermediate positions).

With further reference to FIG. 13, the engagement features 32A-32C of the retainer mechanism 26 are shown in the retracted position. In the retracted position, the engagement features 32A-32C are spaced away from the inner perimeter surface 3 of the aperture 1 a distance D, such that the engagement features 32A-32C are not engaged with the inner perimeter surface 3 of the aperture 1. In this way, a user can set the cover device 10 in-place on an open aperture 1 without interference from the engagement features 32A-32C when the engagement features 32A-32C are in the retracted position. As set in-place on the aperture 1, the perimeter 24 of the inner surface 16 of the cover device 10 is shown spaced outwardly from the opening 5 of the aperture 1. In this way, the inner surface 16 of the cover device 10 partially abuts a support surface in which the aperture 1 is disposed. The distance D between the engagement features 32A-32C is covered by the engagement features 32A-32C when the engagement features 32A-32C are deployed by a user from the retracted position to the deployed position, as shown in FIG. 15.

Figure 14:
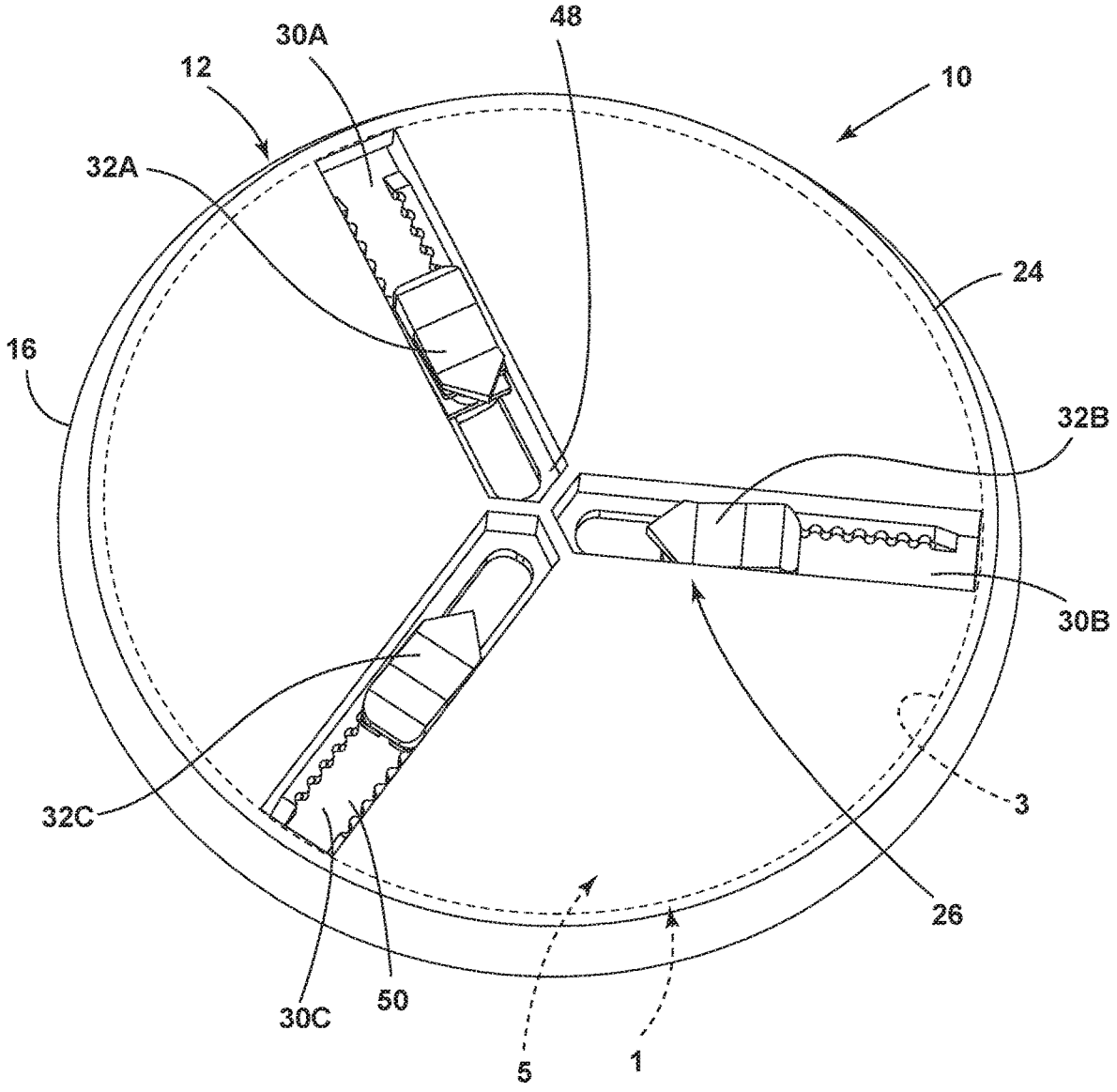
FIG. 14 is a top perspective view of the cover device of FIG. 1 showing the engagement features of the retainer mechanism in an intermediate position.

With reference to FIG. 14, the cover device 10 is shown with the retainer mechanism 26 in an intermediate position. The retainer mechanism 26 may be positioned in one of a plurality of intermediate positions. In the intermediate position, the individual engagement features 32A-32C of the retainer mechanism 26 are spaced apart from the first and second ends 48, 50 of the elongated channels 30A-30C, respectively. In various examples, at least one of the intermediate positions may also be a retracted position as the engagement features 32A-32A may be spaced-apart from the inner perimeter surface 3 of the aperture 1. Alternatively, at least one of the intermediate positions between the first and second ends 48, 50 may be the engaged position depending on the size and/or shape of the aperture 1.

Figure 15:
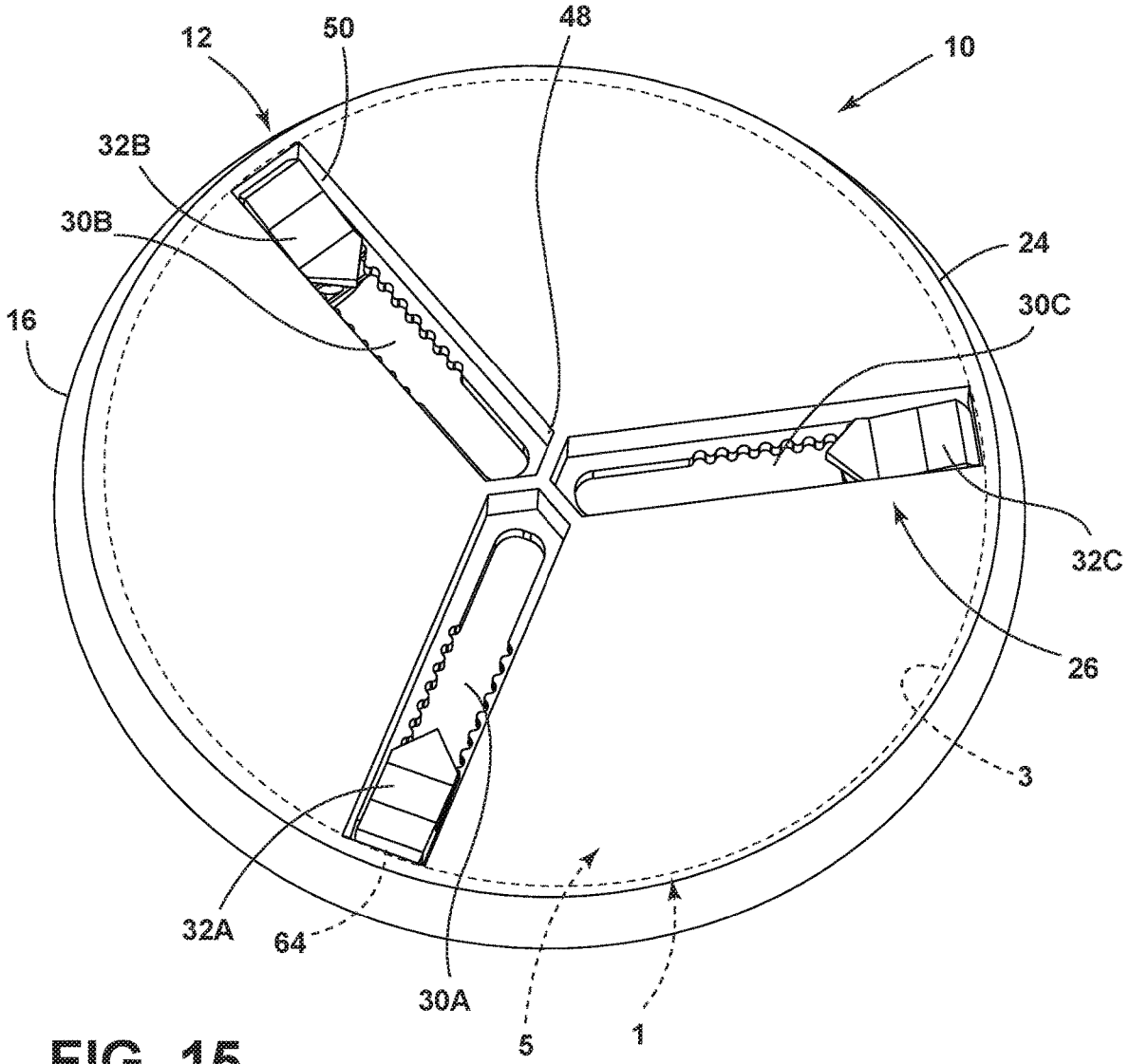
FIG. 15 is a top perspective view of the cover device of FIG. 1 showing the engagement features of the retainer mechanism in a deployed position.

With reference to FIG. 15, the cover device 10 is shown with the retainer mechanism 26 in the deployed position, such that the individual engagement features 32A-32C are both deployed and engaged with the inner perimeter surface 3 of the aperture 1 in an abutting relationship. In this way, the cover device 10 is secured to the aperture 1, as the engagement features 32A-32C retain the cover device 10 in place on the aperture. A user can set the cover device 10 in place on an open aperture 1 with the engagement features 32A-32C in the retracted position. The user may then move the engagement features 32A-32C along the elongated channels 30A-30C, such that the engagement members 64 engage the inner perimeter surface 3 of the aperture 1. In this way, the cover device 10 may be retained and/or secured over the aperture 1. It is contemplated that the user may engage the engagement members 64 of all of the engagement features 32A-32C, or may engage at least one of the engagement features 32A-32C.

With further reference to FIG. 15, the engagement features 32A-32C are shown having been deployed by a user. A user may slide each engagement feature 32A-32C to the deployed position. The deployed position of the engagement features 32A-32C may depend on the size and/or shape of the aperture. For example, the engagement features 32A-32C may be disposed adjacent to the second ends 50 of the elongated channels 30A-30C, respectively, when in the deployed position. Alternatively, the engagement features 32A-32C may be disposed between the first and second ends 48, 50 of the elongated channels 30A-30C, respectively, when in an engaged position for a smaller aperture 1. The engagement members 64 of the engagement features 32A-32C are contemplated to be flexible resilient features, which can abut an exposed surface of an aperture, such as inner perimeter surface 3 of aperture 1, to hold the cover device 10 in place on the aperture.

Figure 16:
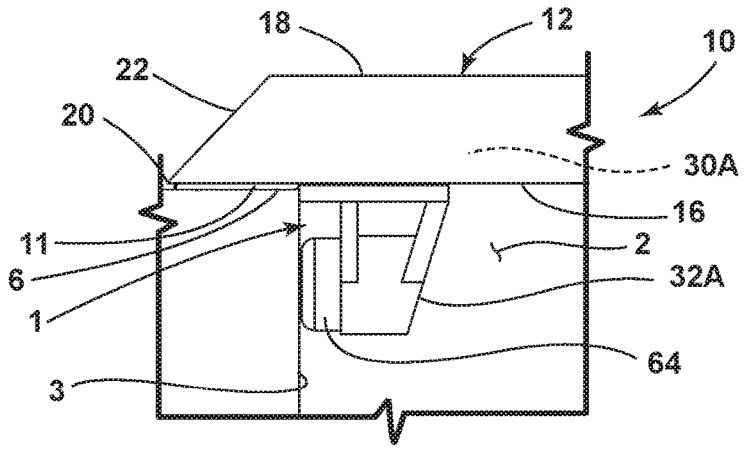
FIG. 16 is a side view of an engagement feature of the cover device of FIG. 1 showing the engagement feature of the retainer mechanism in an engaged position.

With reference now to FIG. 16, the cover device 10 is shown positioned over an aperture 1 disposed through a support surface 6. The engagement feature 32A is shown in the engaged position. When in the engaged position, the engagement member 64 abuts the inner perimeter surface 3 of the aperture 1. The engaged position of the engagement feature 32A, and similarly with the engagement features 32B-32C, retain the cover device 10 over the aperture 1. The engagement features 32A-32C may be disposed anywhere along the elongated channels 30A-30C when the engagement features 32A-32C are in the engaged position. The engaged position may coincide with or be separate from the deployed position shown in FIG. 15. Where the engagement features 32A-32C are positioned relative to the elongated channels 30A-30C may depend on the size and/or shape of the aperture 1. As further shown in FIG. 16, the seal member 11 is positively captured between the cover plate 12 and the support surface 6. As noted above, the seal member 11 may be operably coupled to the inner surface 16 of the cover plate 12, and may extend downwardly therefrom, such that the seal member 11 seals against the support surface 6 through which the aperture 1 is disposed.

With reference to FIGS. 1-16, a disk-shaped cover plate 12 has been described herein, however, other configurations (such as rectangles, squares, and the like) are contemplated for use with the present concept without departing form the spirit of the present concept. Accordingly, with reference to FIG. 17, a cover device 10A is shown having a square-shaped cover plate 12. The cover plate 12 of the cover device 10A shown in the embodiment of FIG. 17 operates in a similar manner to the disk-shaped cover plate 12 illustrated in FIGS. 1-16. The square-shaped cover plate 12 has the outer surface 18 and the inner surface 16 coupled by the side portion 20, which may form the beveled edge 22. Further, the inner surface 16 may define the plurality of elongated channels 30, which comprises individual elongated channels 30A-30D. The elongated channels 30A-30D may be disposed within the plurality of recesses 34, which includes individual recesses 34A-34D. The cover device 10A may include the plurality of engagement features 32, including individual engagement features 32A-32D, slidably engaged with the elongated channels 30A-30D, respectively. The elongated channels 30A-30D may extend radially outward from the center portion 36 of the cover plate 12. The engagement features 32A-32D are operable between the deployed and retracted positions along the elongated channels 30A-30D. Accordingly, the engagement features 32A-32D may be spaced-part from the inner perimeter surface 3 of the aperture 1 when in the retracted position and engage the inner perimeter surface 3 when in the deployed position. Further, the engagement features 32A-32D may also include the locking mechanisms 66, which provide for the unlocked position, for moving the engagement features 32A-32D along the elongated channels 30A-30D, and the locked position to retain the engagement features 32A-32D within a selected position. Additionally, while the square-shaped cover plate 12 is illustrated with a square-shaped aperture 1, the shape of the cover plate 12 and the aperture 1 may differ.

Use of the present disclosure may provide a variety of advantages. For example, the beveled edge 22 surrounding the side portion 20 of the cover plate 12 may result in less of an obstruction when placed over an aperture 1 on a floor surface as compared to a section of plywood having a blunt 90-degree edge. Further, the beveled edge 22 also allows for easy clean up around a jobsite when sweeping a floor surface on which the cover device 10 is positioned. Additionally, the plurality of engagement members 64 may allow the cover device 10 to be used with apertures 1 of varying sizes and/or shapes. Moreover, the plurality of engagement members 64 may allow the cover device 10 to be secured in position over the aperture 1.

In various examples, not all of the engagement features 32A-32C may be slideable along the elongated features 30A-30C. In such examples, some of the engagement features 32A-32C may be fixed in a selected position. The cover device 10 may be placed over the opening 5 of the aperture 1 with at least one of the engagement features 32A-32C fixed in a position such that the fixed engagement features (e.g., at least one of the engagement features 32A-32C) abut the inner perimeter surface 3 of the aperture 1. Once the cover device 10 is aligned over the aperture 1 with the fixed engagement features abutting the inner perimeter surface 3, the slideable engagement features may be moved to the engaged position, such that all of the engagement features 32A-32C are engaged with the inner perimeter surface 3. It is also contemplated that the square cover device 10 having engagement features 32A-32D may be operated in a similar manner.

Figure 18:
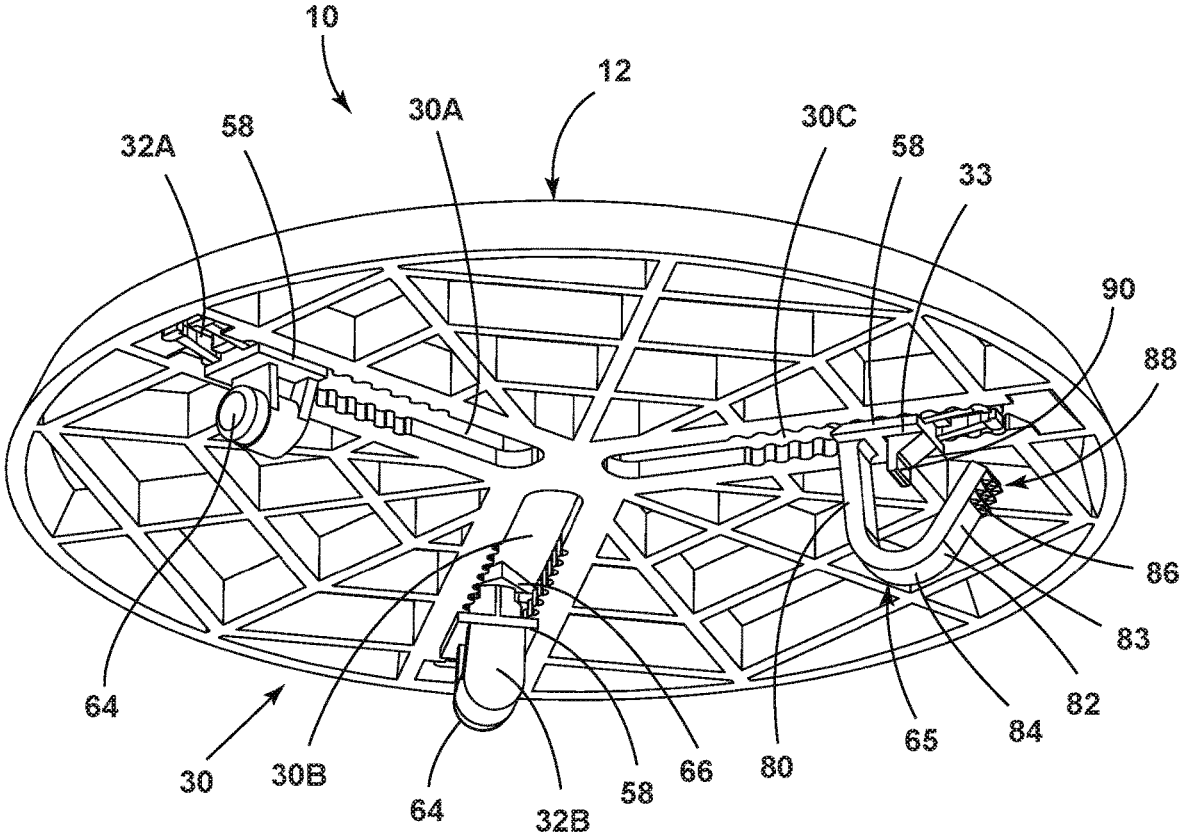
FIG. 18 is a bottom perspective view of a cover device according to another embodiment.

Referring now to FIG. 18, the cover device 10 of FIGS. 1-16 is shown. The cover device 10 illustrated in FIG. 18 includes the plurality of engagement features 32, including individual engagement features 32A and 32B, described above, and engagement feature 33. The individual engagement features 32A, 32B and 33 are slidably engaged with the elongated channels 30A-30C, respectively. As discussed above, the engagement features 32A and 32B are operable between the deployed and retracted positions along the elongated channels 30A, 30B. Further engagement feature 33 is also operable between the deployed and retracted positions along the elongated channel 30C. The engagement features 32A, 32B and 33 are contemplated to include the locking mechanisms 66 discussed above, which provide for the unlocked position, for moving the engagement features 32A, 32B and 33 along the elongated channels 30A-30C, and the locked position to retain the engagement features 32A, 32B and 33 within a selected position. While the engagement features 32A, 32B include engagement members 64 for engaging the inner perimeter surface 3 of the sidewall 4 of an aperture 1 (as shown in FIG. 16), the engagement feature 33 includes a different type of engagement member 65. As specifically, shown in FIG. 18, the engagement members 64 extend downwardly from the lower plate 58 of the engagement features 32A, 32B. With respect to engagement feature 33, engagement member 65 includes a first portion 80 that extends downwardly from the lower plate 58. The first portion 80 of the engagement member 65 is interconnected with a second portion 82 of the engagement member 65 by a curved portion 84. Thus, the engagement member 65 is contemplated to be a unitary part having first and second portions 80, 82 and the curved portion 84, such that the first and second portions 80, 82 that are disposed in a generally U-shaped configuration. The second portion 82 is contemplated to be flexibly resilient and define a spring finger 83 of the engagement member 65. The second portion 82 further includes a head portion 86 having a plurality of bumper members 88 disposed thereon, wherein the bumper members 88 may provide a textured engagement surface 89 (FIG. 19A) for the spring finger 83. It is also contemplated that the bumper members 88 may be flexibly resilient members comprised of a deformable material, such as rubber or foam. Like the engagement members 64, the engagement member 65 extends below the inner surface 16 of the cover plate 12 to engage an inner perimeter surface of a covered aperture.

Figure 19A:
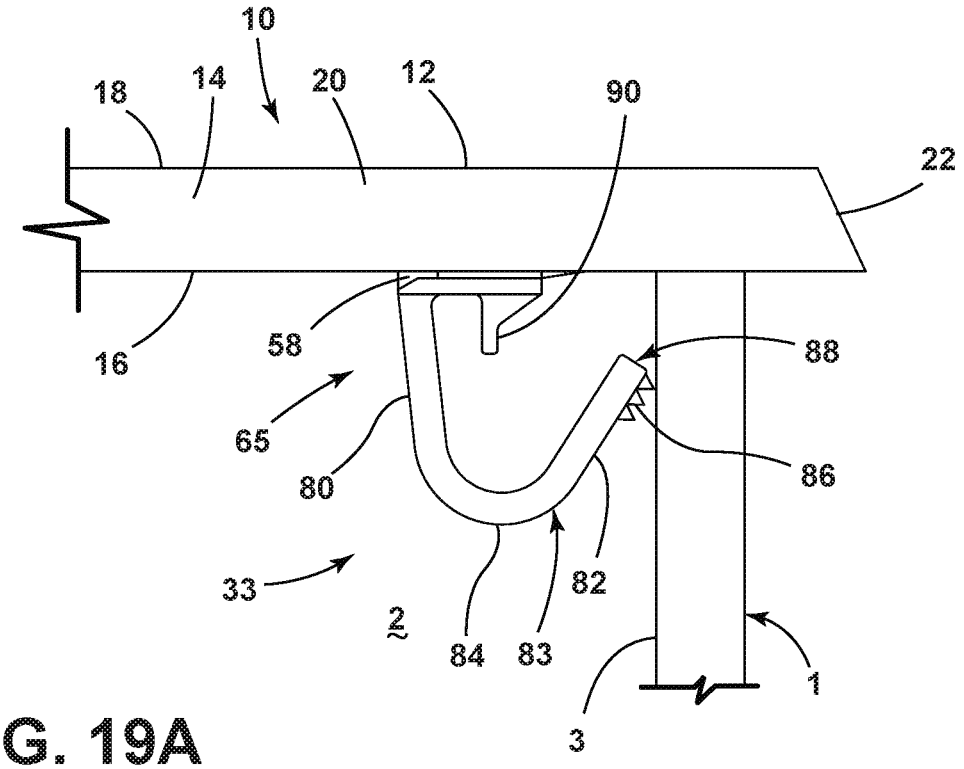
FIG. 19A is a fragmentary side elevation view of the cover device of FIG. 18 positioned over an aperture with an engagement feature in a retracted position.
Figure 19B:
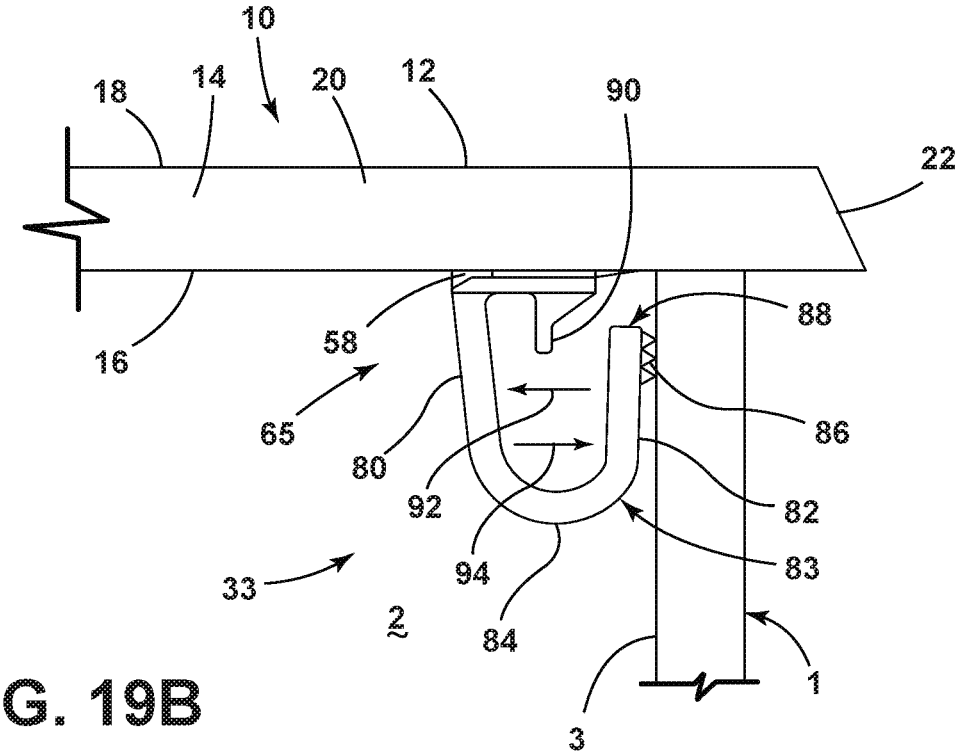
FIG. 19B is a fragmentary side elevation view of the cover device of FIG. 19A showing the engagement feature in a deployed position.

As noted above, the second portion 82 is contemplated to be flexibly resilient and defines a spring finger 83 of the engagement member 65. Thus, the second portion 82 is configured to inwardly flex at the curved portion 84 of the engagement member 65 to rearwardly deflect when engaged with an inner surface of an aperture covered by the cover device 10. This flexibility is best shown in FIGS. 19A and 19B. Being not only flexible, but resiliently flexible, the spring finger 83 is configured to return to its at-rest form from a flexed position when engagement with an associated surface has ceased. As further shown in FIG. 18 the engagement feature 33 includes a tab 90 downwardly extending from the lower plate 58 which is provided to limit an amount of inward flexibility of the spring finger 83.

Referring now to FIG. 19A, the cover device 10 is shown received in the receiving well 2 of an aperture 1, wherein the engagement feature 33 has approached a fully deployed position along the cover plate 12. As the engagement feature 33 has not been fully deployed in FIG. 19A, the engagement member 65, or the spring finger 83 thereof, is shown in an at-rest condition. Referring now to FIG. 19B, engagement feature 33 is in the fully deployed position. With the engagement feature 33 in the fully deployed position, the head portion 86 of the spring finger 83 of the engagement member 65 has engaged the inner perimeter surface 3 of the aperture 1, such that the second portion 82 of the engagement member 65 has inwardly flexed in the direction as indicated by arrow 92. Thus, in FIG. 19B, the engagement member 65 is shown in the flexed condition. In flexed condition, the spring finger 83 of the engagement feature 33 provides for a tensioned engagement of the inner perimeter surface 3 of the aperture 1 covered by the cover device 10. With this tensioned engagement, the cover device 10 is more firmly engaged with the aperture 1. In the manner as noted above, it is contemplated that as the engagement feature 33 moves inwardly along the cover plate 12 in its associated channel 30C (FIG. 18) from the fully deployed position towards the retracted position, the flexibly resilient spring finger 83 of the engagement member 65 will spring back to its original at-rest condition (as shown in FIG. 19A) in the direction as indicated by arrow 94. It is contemplated that the engagement features 32A, 32B may also be in the form of a tensioned providing engagement feature, such as engagement feature 33. It is also contemplated that any combination of engagement features can be used with a desired cover device 10.

Figure 17:
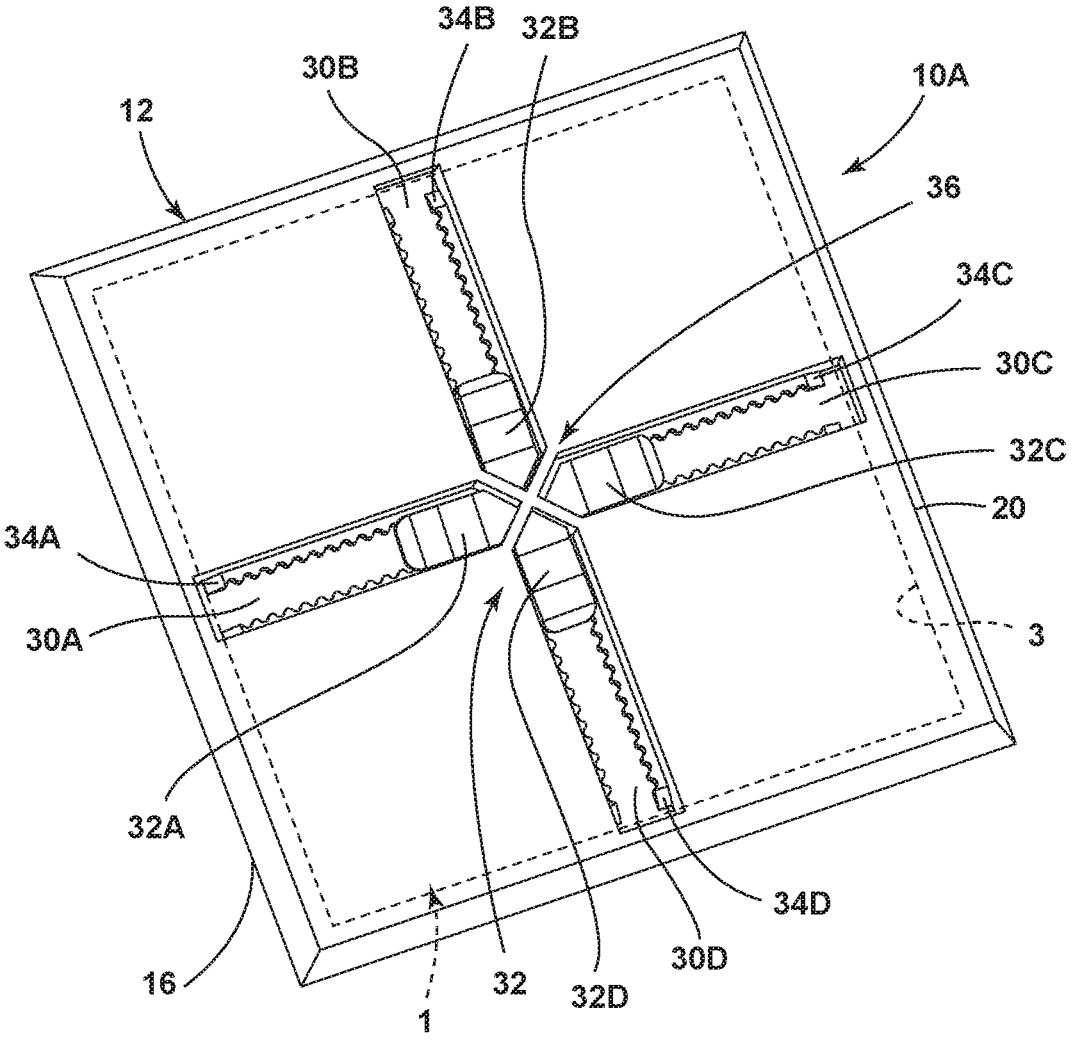
FIG. 17 is a top perspective view of a cover device.
Figure 20A:
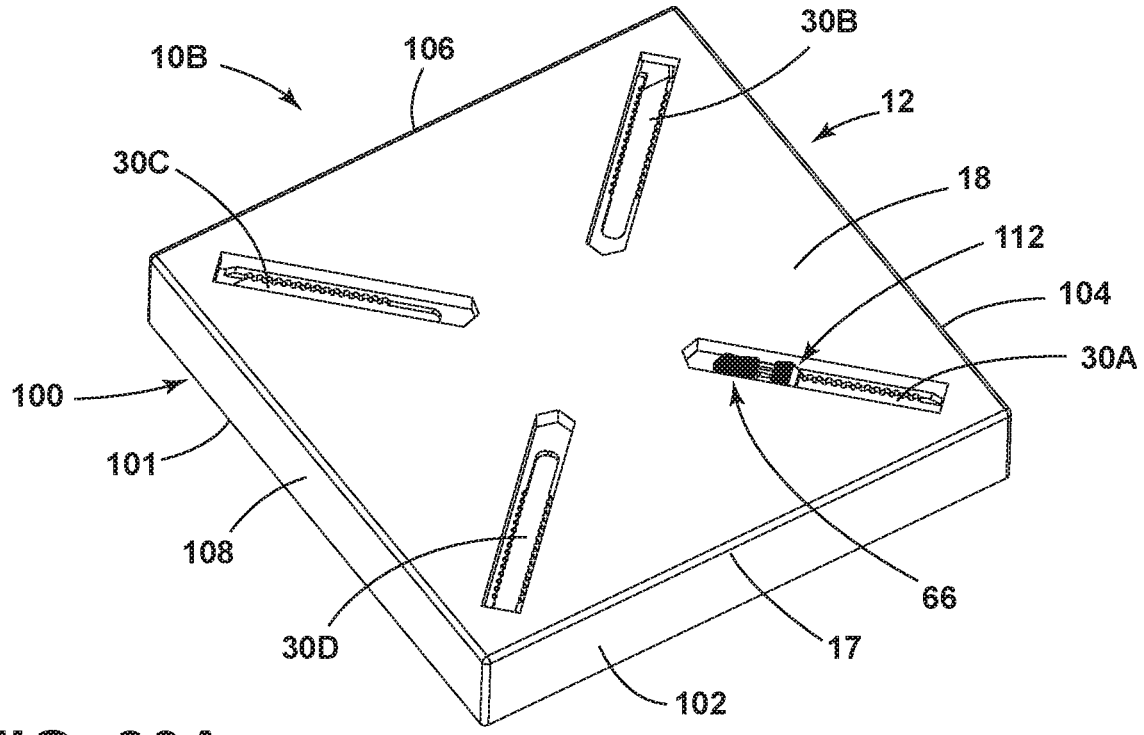
FIG. 20A is a top perspective view of a cover device according to another embodiment.
Figure 20B:
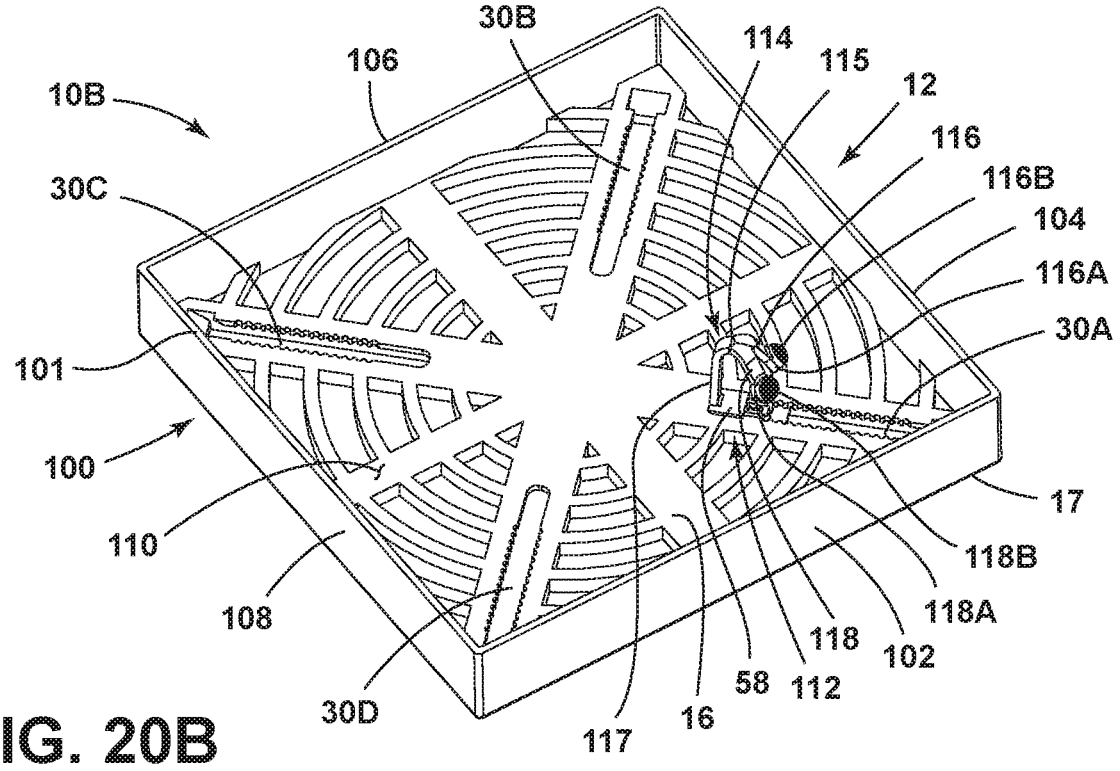
FIG. 20B is a bottom perspective view of the cover device of FIG. 20B.

Referring now to FIGS. 20A and 20B, a cover device 10B is shown having a square-shaped cover plate 12. The cover plate 12 of the cover device 10B shown in the embodiment of FIGS. 20A, 20B operates in a similar manner to the disk-shaped cover plate 12 illustrated in FIGS. 1-16 and 18, as well as the square-shaped cover plate 12 of FIG. 17. The square-shaped cover plate 12 of FIGS. 20A and 20B has the outer surface 18 and the inner surface 16. A sidewall 100 extends outwardly from the inner surface 16 and surrounds a perimeter 17 of the cover plate 12. The sidewall 100 includes four different interconnected sides 102, 104, 106 and 108 that cooperate with each other and the cover plate 12 to define an inner cavity 110. The interconnected sides 102, 104, 106 and 108 of the sidewall 100 all culminate in a bottom edge 101 of the sidewall 100. In a manner as noted above, the cover plate 12 includes a plurality of elongated channels 30, which comprises individual elongated channels 30A-30D. The elongated channels 30A-30D may extend radially outward from the center portion 36 of the cover plate 12. The cover device 10B may include the plurality of engagement features, much like individual engagement features 32A-32D, slidably engaged with the elongated channels 30A-30D, respectively, as shown in FIG. 17. In the embodiment of FIGS. 20A and 20B a single engagement feature 112 is shown as being slidably engaged with elongate channel 30A, however, other engagement features are contemplated to be received in elongate channels 30B-30D as well. The engagement feature 112 includes the locking mechanism 66 discussed above, which provides for the locked and unlocked conditions that allow for movement and retaining the engagement feature 112 in a desired location along the elongate channel 30A. The engagement feature 112 is operable between the deployed and retracted positions along the elongated channel 30A. In this way, the engagement feature 112, along with other associated engagement features, can retain the cover device 10B in place over an aperture.

As further shown in FIG. 20B, the engagement feature 112 includes an engagement member 114 that downwardly extends from the lower plate 58. The engagement member 114 is shown in the form of a dual headed spring finger. Specifically, the engagement member 114 includes a base portion 117 that extends downwardly from the lower plate 58. The base portion 117 of the engagement member 114 is interconnected with first and second spring fingers 116, 118 of the engagement member 114 by a curved portion 115. Thus, the engagement member 114 is contemplated to be a unitary part having the base portion 117, the curved portion 115, and the first and second spring fingers 116, 118 such that the engagement member 114 includes a generally U-shaped configuration. Much like the second portion 82 of the engagement feature 33 described above, the first and second spring fingers 116, 118 are contemplated to be flexibly resilient. The first and second spring fingers 116, 118 each include a head portion 116A, 118A, respectively. The head portions 116A, 118A include bumper members 116B, 118B, respectively, that are contemplated to be flexibly resilient members comprised of a deformable material, such as rubber or foam. Like the bumper members 88 of the engagement feature 33, the bumper members 116B, 118B provide a gripping feature for the engagement of an inner surface of an aperture as further described below.

Having the inner cavity 110, the cover device 10B can be used to cover upwardly extending apertures, such as drains that extend upwardly from the floor surface. Specifically, with the sidewall 100 extending downwardly from the inner surface 16 of the cover plate 12, the sidewall 100 acts as a standoff feature for an abutment surface from which a drain, or other like aperture, may upwardly extend.

Figure 21A:
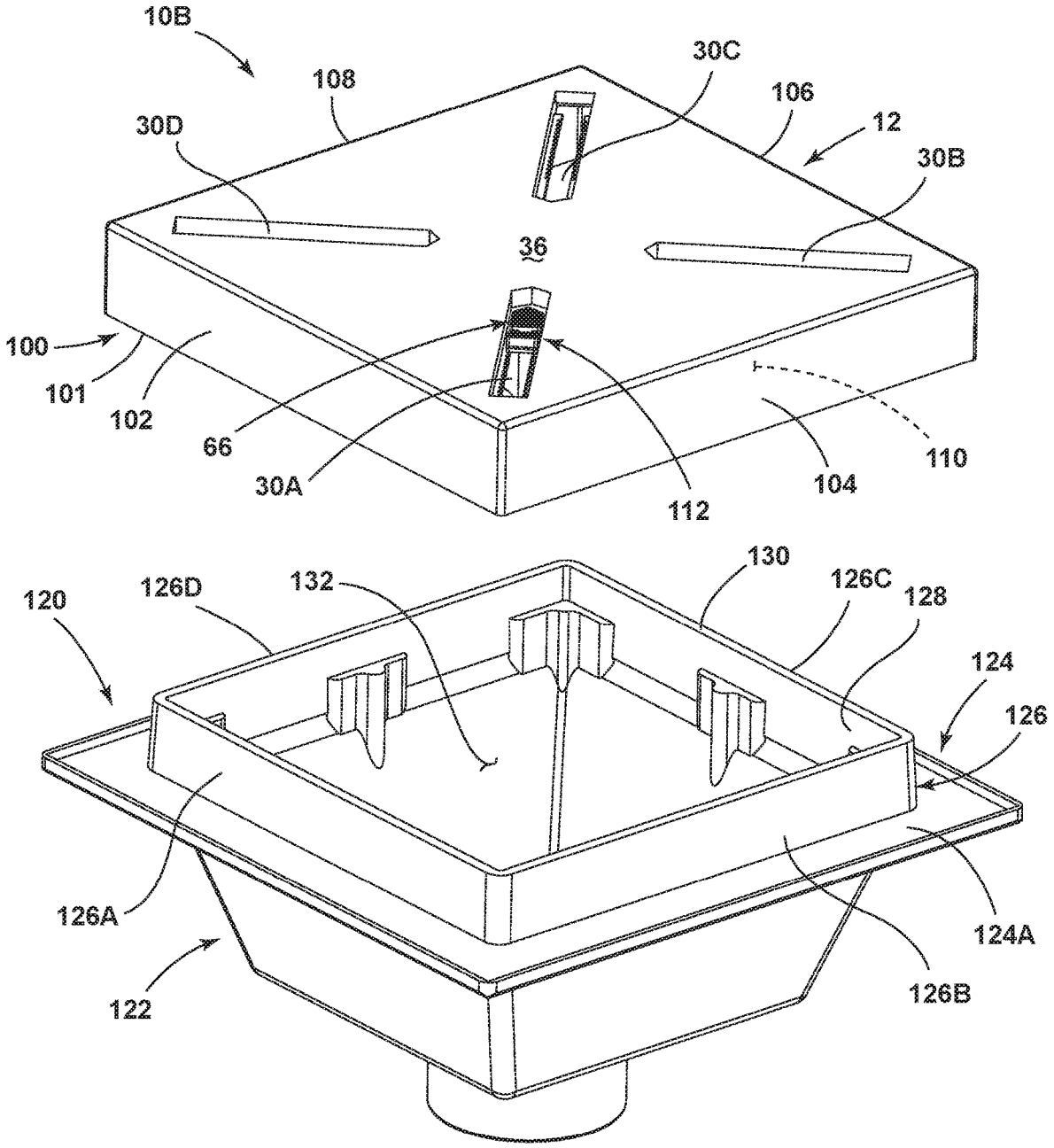
FIG. 21A is a top perspective view of the cover device of FIG. 20A exploded away from a floor drain.

Referring now to FIG. 21A, the cover device 10B is shown exploded away from a floor drain 120 shown in the form of a floor sink. The floor drain 120 includes a body portion 122 having an outwardly extending flange 124 with a square-shaped configuration. The outwardly extending flange 124 surrounds a square-shaped aperture 126 that extends upwardly from the outwardly extending flange 124. The square-shaped aperture 126 includes four sides 126A, 126B, 126C and 126D. The four sides 126A, 126B, 126C and 126D of the square-shaped aperture 126 are configured to be covered by the sides 102, 104, 106 and 108 of the sidewall 100 of the cover device 10B. In use, the outwardly extending flange 124 may be used to engage the floor drain 120 with a cement overlay. While the floor drain 120 is provided in a construction site, it may be advantageous to cover the floor drain 120 with the cover device 10B of the present concept to avoid having any open apertures on a construction site. The aperture 126 includes an inner surface 128 and an upper edge 130. The upper edge 130 opens into a receiving well 132 of the floor drain 120.

Figure 21B:
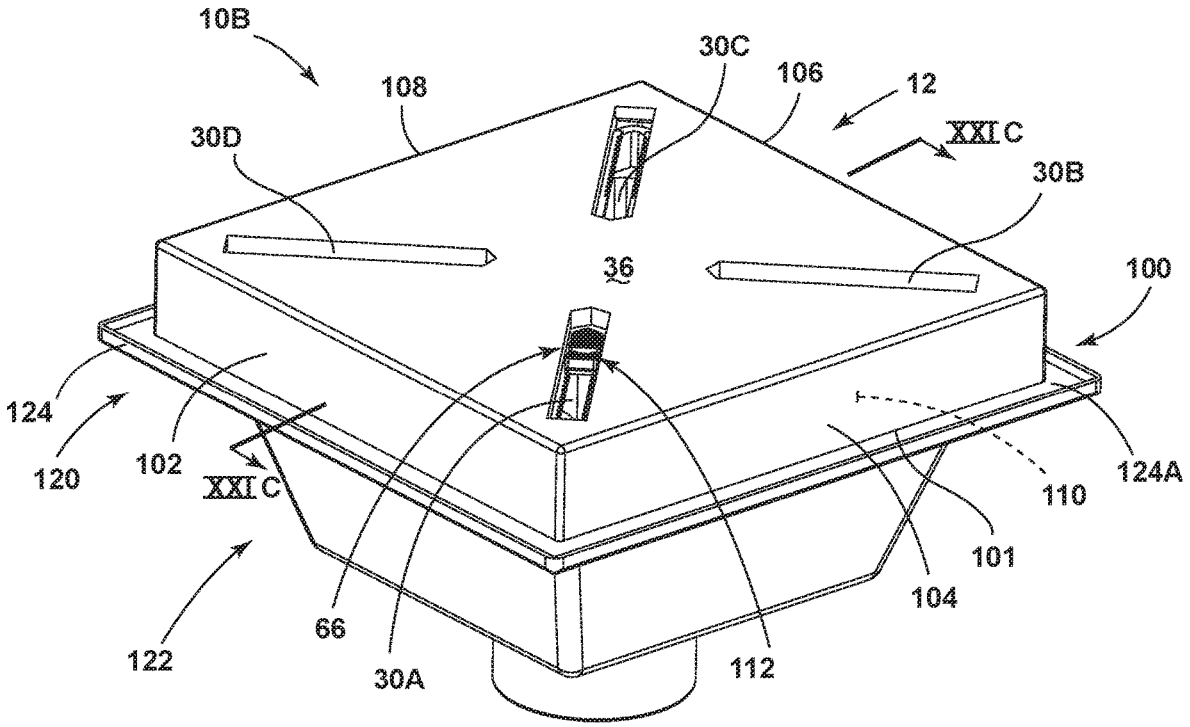
FIG. 21B is a top perspective view of the cover device of FIG. 21A positioned on the floor drain.

Referring now to FIG. 21B, the cover device 10B is shown disposed over the upwardly extending square-shaped aperture 126 of the floor drain 120, such that the square-shaped aperture 126 is received within the inner cavity 110 of the cover device 10B. Further, with the cover device 10B disposed over the square-shaped aperture 126, the engagement member 114 of engagement feature 112 is contemplated to be received within the receiving well 132 of the floor drain 120. In FIG. 21B, the engagement feature 112 is shown in the retracted position, and is ready for movement to the deployed position with the cover device 10B being fully received on the floor drain 120 over the aperture 126. With the cover device 10B disposed over the aperture 126, the bottom edge 101 of the sidewall 100 abuts the upper surface 124A of the outwardly extending flange 124. In this way, the upper surface 124A acts as an abutment surface to support the cover device 10B at the bottom edge 101 of the sidewall 100 thereof.

Figure 21C:
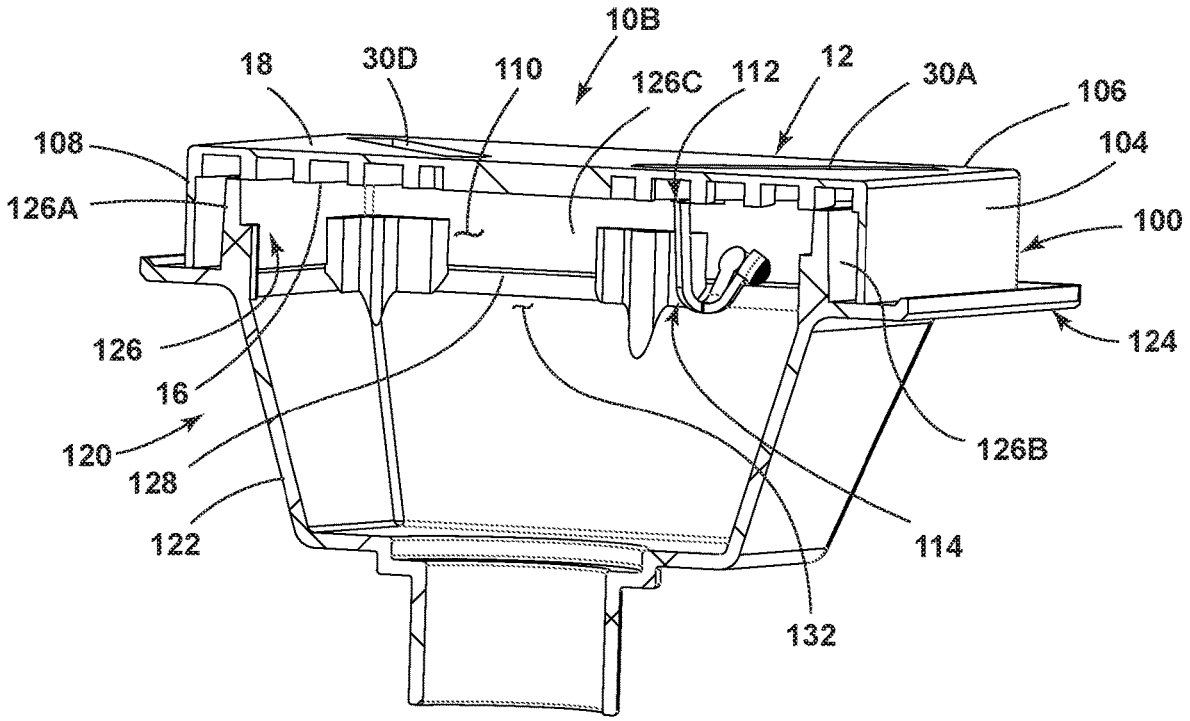
FIG. 21C is a cross-sectional view of the cover device and floor drain of FIG. 21B taken along line XXIC showing an engagement feature in a retracted position.

Referring now to FIG. 21C, the cross-sectional view of the cover device 10B and the floor drain 120 shows the square-shaped aperture 126 disposed within the inner cavity 110 of the cover device 10B. In the cross-sectional view, the sides 104 and 108 of the sidewall 100 of the cover device 10B are shown disposed adjacent to the sides 126B and 126D of the square-shaped aperture 126, respectively. The engagement feature 112 is shown having the engagement member 114 disposed within the receiving well 132 of the floor drain 120. Specifically, the engagement feature 112 is shown in the retracted position, and is ready for movement to the deployed position to retain the cover device 10B on the square-shaped aperture 126.

Figure 22:
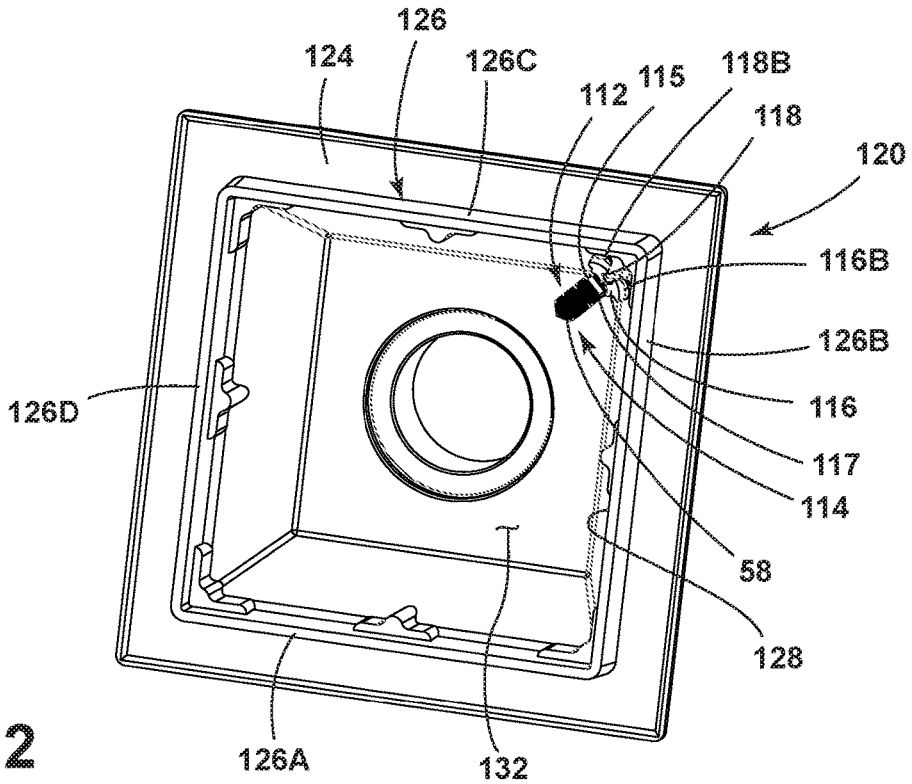
FIG. 22 is a top perspective view of the floor drain of FIG. 21B with a cover plate of the cover device of FIG. 21B removed to reveal an engagement feature positioned in a deployed position.

Referring now to FIG. 22, the cover device 10B has been removed to clearly illustrate the engagement feature 112 shown in the deployed position. In the deployed position, the engagement member 114 of the engagement feature 112 is shown engaging the inner surface 128 of the square-shaped aperture 126 at sides 126B and 126C. In this way, the dual headed engagement member 114 provides the first and second spring fingers 116, 118 that can both separately engage adjacent sides 126B, 126C of the square-shaped aperture 126, respectively. Thus, in a configuration where four engagement features are provided with the cover device 10B, all four corners of the square-shaped aperture 126 would be engaged on the inner surface 128 thereof by the spring fingers of the associated engagement members. In this way, the cover device 10B can be securely mounted to an upwardly extending aperture, such as the square-shaped aperture 126 of the floor drain 120. Much like the spring finger 83, the first and second spring fingers 116, 118 are operable between flexed and at-rest conditions and are contemplated to be in the flexed condition in FIG. 22 as engaged with the inner surface 128 of the square-shaped aperture 126. As such, the first and second spring fingers 116, 118 are configured to move back to the at-rest condition after the tension is removed between the engagement feature 112 and the inner surface 128 of the square-shaped aperture 126 by sliding the engagement feature 112 rearwardly towards the retracted position from the deployed position shown in FIG. 22.

Figure 23:
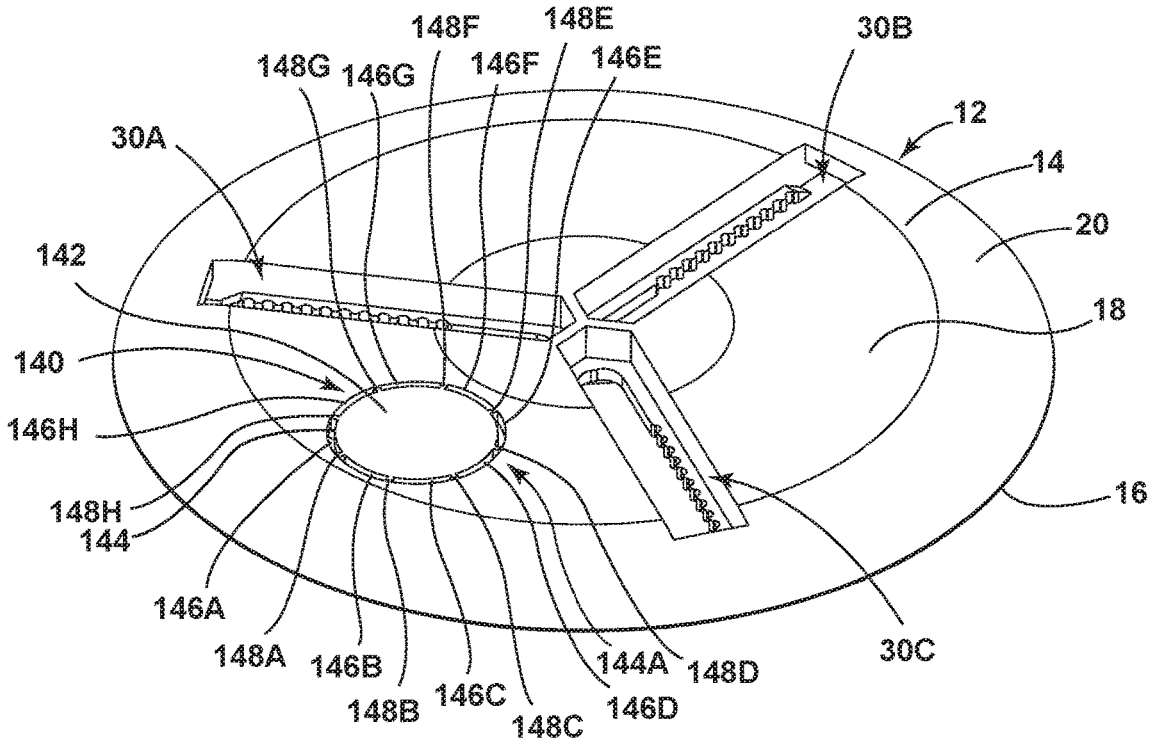
FIG. 23 is a top perspective view of a cover device according to another embodiment having a punch-out member.
Figure 24:
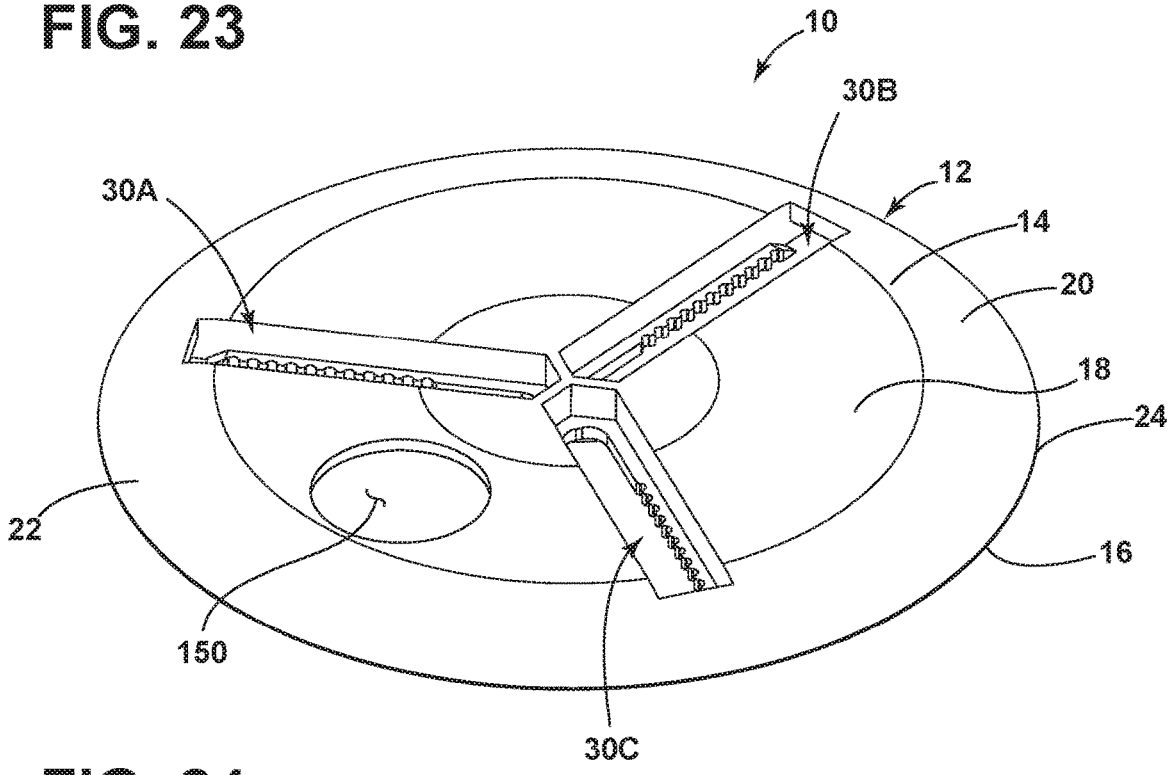
FIG. 24 is a top perspective view of the cover device of FIG. 23 with the punch-out member removed.

Referring now to FIG. 23, the cover device 10 illustrated in FIG. 18 is shown with the plurality of engagement features 32 removed therefrom. In the embodiment shown in FIG. 23, the cover plate 12 of the cover device 10 includes a punch-out member 140 disposed through the body portion 14 of the cover plate 12. The punch-out member 140 includes a body portion 142 shown in the form of a circular member. The body portion 142 includes an outer perimeter 144 along which a plurality of relief portions 146A-146H are disposed. As shown in FIG. 23, the relief portions 146A-146H generally follow the outer perimeter 144 of the body portion 142 of the punch-out member 140. Between the relief portions 146A-146H, attachment tabs 148A-148H are disposed which interconnect the body portion 142 of the punch-out member 140 to the body portion 14 of the cover plate 12. The attachment tabs 148A-148H are contemplated to be breakaway members which can be used to breakaway the body portion 142 of the punch-out member 140 to thereby provide an aperture 150 through the cover plate 12 of the cover device 10, as best shown in FIG. 24. Thus, it is contemplated that the attachment tabs 148A-148H are rigid enough to hold the body portion 142 of the punch-out member 140 in-place, yet configured to breakaway under a pressure force applied by a user in an upward or downward direction through the cover plate 12. Thus, the attachment tabs 148A-148H may include thinned pieces of polymeric material that can snap off as needed. Together, the attachment tabs 148A-148H and the relief portions 146A-146H define a perforated portion 144A surrounding the outer perimeter 144 of the body portion 142 of the punch-out member 140. It is also contemplated that the ribs 28 (FIG. 1) disposed on the inner surface 16 of the cover plate 12 may be configured to avoid the punch-out member 140, such that the punch-out member 140 can be easily removed. In this way, the punch-out member 140 is a feature that provides an on-demand aperture 150 through the cover plate 12, which may be needed in a particular application. For example, a power cord can be run through a floor surface aperture between floors in a construction site. If such a floor surface aperture were to be covered by the cover device 10, an access aperture for the power cord would be desired. In such a situation, the cover device 10 shown in the embodiments of FIGS. 23 and 24 can provide an access aperture, by way of aperture 150, to run a cord or cabling of any kind through the cover device 10. It is contemplated that the relief portions 146A-146H may extend through the body portion 14 of the cover plate 12, or may define recess that recess inwardly from one of the inner surface 16 or the outer surface 18 of the cover plate 12 into the body portion 14 of the cover plate 12.

Figure 25:
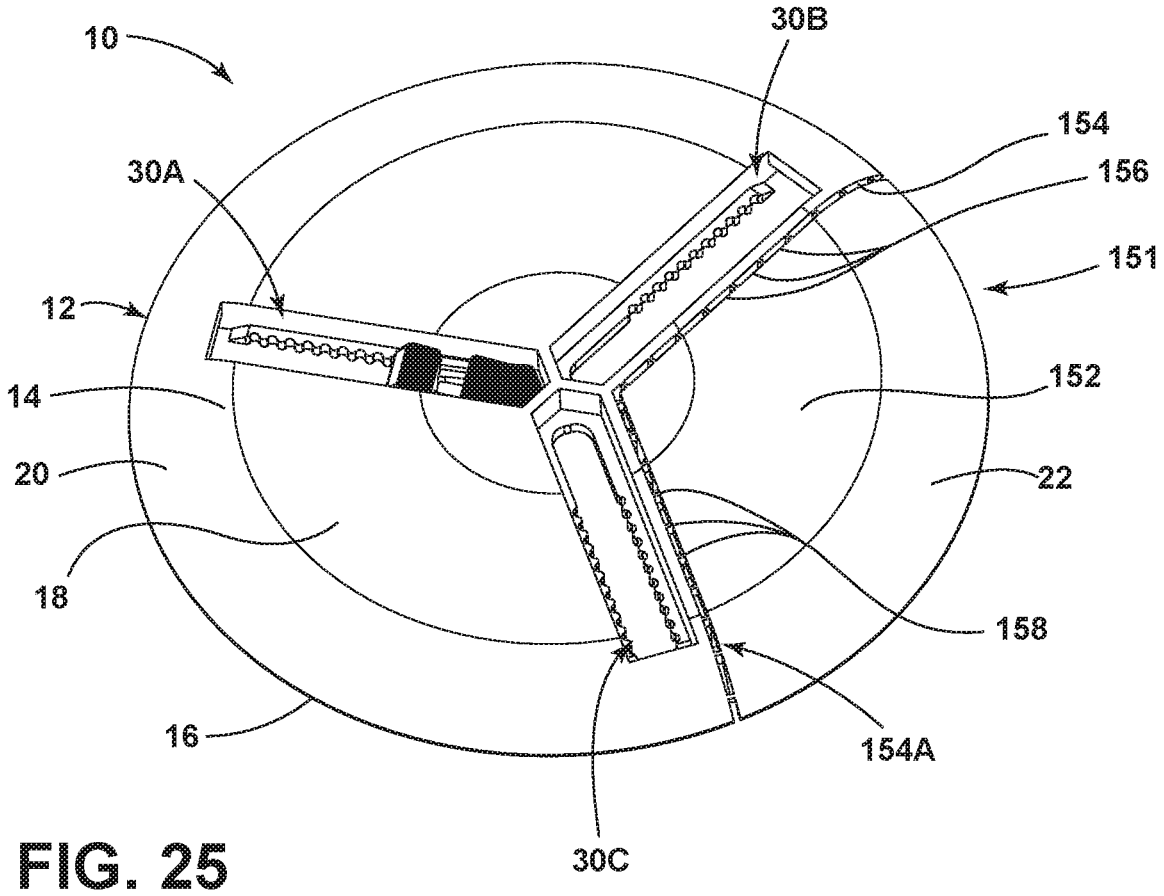
FIG. 25 is a top perspective view of a cover device according to another embodiment having a punch-out section.
Figure 26:
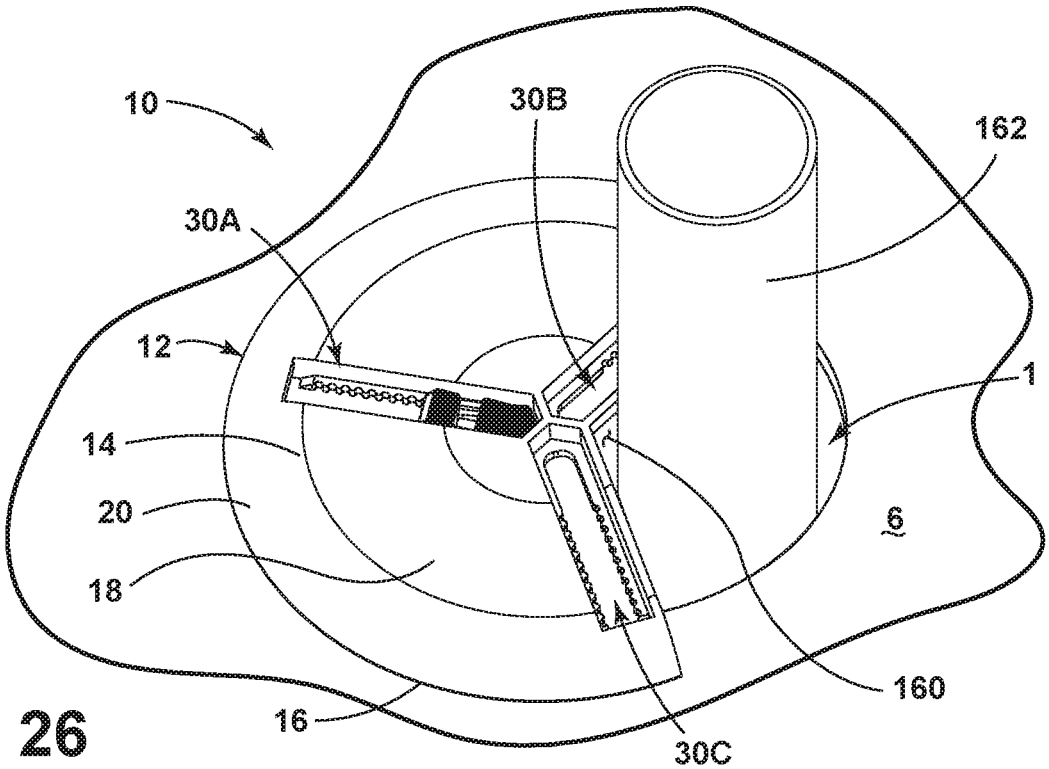
FIG. 26 is a top perspective view of the cover device of FIG. 25 disposed over an aperture on a support surface with the punch-out section removed.

Referring now to FIG. 25, the cover plate 12 of the cover device 10 includes a punch-out section 151 disposed through the body portion 14 of the cover plate 12. The punch-out section 151 includes a body portion 152 shown in the form of a triangular portion of the cover plate 12. The body portion 152 of the punch-out section 151 includes an outer perimeter 154. Portions of the outer perimeter 154 that are disposed adjacent to the body portion 14 of the cover plate 12 include a plurality of relief portions 156. Between the relief portions 156, attachment tabs 158 are disposed which interconnect the body portion 152 of the punch-out section 151 to the body portion 14 of the cover plate 12. The attachment tabs 158 are contemplated to be breakaway members which can be used to breakaway the body portion 152 of the punch-out section 151 to thereby provide an opening 160 through the cover plate 12 of the cover device 10, as best shown in FIG. 26. Thus, the attachment tabs 158 and the relief portions 156 define a perforated portion 154A surrounding the outer perimeter 154 of the body portion 152 of the punch-out section 151. It is also contemplated that the ribs 28 (FIG. 1) disposed on the inner surface 16 of the cover plate 12 may be configured to avoid the punch-out section 151, such that the punch-out section 151 can be easily removed. In this way, the punch-out section 151 is a feature that provides an on-demand section opening 160 through the cover plate 12, which may be needed in a particular application. As shown in the example of FIG. 26, a pipe 162 extends the section opening 160 while the cover device 10 covers an aperture disposed on a support surface 6.

In at least one aspect, a cover device for use with an aperture disposed through a surface and having an inner perimeter surface includes a cover plate having a body portion with inner and outer surfaces and at least one elongated channel disposed therethrough. The cover plate includes a plurality of retention members extending inwardly into the at least one elongated channel. At least one engagement feature is operably coupled to the cover plate at the at least one elongated channel and slidably disposed along the at least one elongated channel between retracted and deployed positions. The at least one engagement feature includes at least one engagement member disposed below the inner surface of the cover plate that engages the inner perimeter surface of the aperture when the at least one engagement feature is in the deployed position when the cover plate is positioned over the aperture.

According to another embodiment, the plurality of retention members includes a first plurality of retention members extending inwardly from a first side of the at least one elongated channel, and a second plurality of retention members extending inwardly from a second side of the at least one elongated channel towards the first plurality of retention members.

According to another embodiment, the first plurality of retention members and the second plurality of retention members align and selectively engage the at least one engagement feature to retain the at least one engagement feature in a plurality of intermediate positions disposed between the retracted and deployed positions.

According to another embodiment, the at least one elongated channel includes a plurality of elongated channels.

According to another embodiment, the at least one engagement feature includes a plurality of engagement features slidably disposed within the plurality of elongated channels, respectively.

According to another embodiment, the plurality of elongated channels extend radially outward from a center portion of the cover plate towards a side portion of the cover plate.

According to another embodiment, the at least one engagement feature includes a slider having one or more spring fingers configured to selectively engage one or more retention members of the plurality of retention members.

According to another embodiment, the at least one engagement feature includes a locking mechanism operable between locked and unlocked positions along the slider.

According to another embodiment, the one or more spring fingers are retained in an engaged position with one or more retention members of the plurality of retention members and the at least one engagement feature is retained in a select position along the at least one elongated channel when the locking mechanism is in the locked position.

In at least another aspect, a cover device includes a cover plate having a body portion with inner and outer surfaces and a channel disposed therethrough. An engagement feature is slidably disposed within the channel between deployed and retracted positions. The engagement feature includes a slider at least partially positioned above the channel and an engagement member positioned below the channel.

According to another embodiment, the engagement member includes a deformable head portion.

According to another embodiment, a plurality of retention members extend inwardly into the channel from opposed sides thereof.

According to another embodiment, a locking mechanism is operable between locked and unlocked positions and allows the engagement feature to move along the channel in the unlocked position, and locks a portion of the engagement feature in engagement with one or more retention members of the a plurality of retention members to lock the engagement feature in a select position along the channel when the locking mechanism is in the locked position.

According to another embodiment, a seal member is operably coupled to the inner surface of the cover plate and extending downwardly therefrom.

According to another embodiment, a punch-out member is disposed along the cover plate and includes a body portion surrounded by a perforated portion that includes relief portions disposed along the body portion of the cover plate.

In at least another aspect, a cover plate includes a body portion with inner and outer surfaces and first and second elongated channels disposed therethrough. A first engagement feature is slidably disposed within the first elongated channel between first and second positions. A second engagement feature is slidably disposed within the second elongated channel between first and second positions.

According to another embodiment, a plurality of retention members is disposed along the first and second elongated channels.

According to another embodiment, a first locking mechanism is disposed on the first engagement feature and is operable between locked and unlocked positions. The first locking mechanism allows the first engagement feature to move along the first channel when the locking mechanism is in the unlocked position, and locks a portion of the first engagement feature in engagement with the retention members of the first channel when the locking mechanism is in the locked position. A second locking mechanism is disposed on the second engagement feature and is operable between locked and unlocked positions The second locking mechanism allows the second engagement feature to move along the second channel when the locking mechanism is in the unlocked position, and locks a portion of the second engagement feature in engagement with the retention members of the second channel when the locking mechanism is in the locked position.

According to another embodiment, a punch-out section is disposed along the cover plate and includes a body portion with a perforated portion disposed along at least a portion of an outer perimeter of the body portion. The perforated portion includes relief portions disposed along the body portion of the cover plate.

According to another embodiment, the first and second engagement features include one or more spring fingers disposed below the inner surface of the cover plate.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A cover device for use with an aperture disposed through a surface and having an inner perimeter surface, comprising:

a cover plate having a body portion with inner and outer surfaces and at least one elongated channel disposed therethrough, wherein the cover plate includes a plurality of retention members extending inwardly into the at least one elongated channel; and at least one engagement feature operably coupled to the cover plate at the at least one elongated channel and slidably disposed along the at least one elongated channel between retracted and deployed positions, the at least one engagement feature including at least one engagement member disposed below the inner surface of the cover plate, wherein the at least one engagement member engages the inner perimeter surface of the aperture when the at least one engagement feature is in the deployed position when the cover plate is positioned over the aperture, and further wherein the at least one engagement feature includes a slider having first and second flexible spring fingers configured to engage select retention members of the plurality of retention members.

2. The cover device of claim 1, wherein the plurality of retention members includes a first plurality of retention members extending inwardly from a first side of the at least one elongated channel, and a second plurality of retention members extending inwardly from a second side of the at least one elongated channel towards the first plurality of retention members.

3. The cover device of claim 2, wherein the first plurality of retention members and the second plurality of retention members align and selectively engage the first and second flexible spring fingers, respectively, to retain the at least one engagement feature in a plurality of intermediate positions disposed between the retracted and deployed positions.

4. The cover device of claim 1, wherein the at least one elongated channel includes a plurality of elongated channels.

5. The cover device of claim 4, wherein the at least one engagement feature includes a plurality of engagement features slidably disposed within the plurality of elongated channels, respectively.

6. The cover device of claim 5, wherein the plurality of elongated channels extend radially outward from a center portion of the cover plate towards a side portion of the cover plate.

7. The cover device of claim 1, wherein the at least one engagement feature includes a locking mechanism operable between locked and unlocked positions along the slider.

8. The cover device of claim 7, wherein a retention block of the lock mechanism engages the first and second flexible spring fingers to retain the first and second flexible spring fingers in an outwardly engaged position with the select retention members of the plurality of retention members, and the at least one engagement feature is retained in a select position along the at least one elongated channel when the locking mechanism is in the locked position.

9. A cover device, comprising:

a cover plate having a body portion with inner and outer surfaces and a channel disposed therethrough, wherein the channel includes a plurality of retention members extending inwardly into the channel from opposed sides thereof; and an engagement feature slidably disposed within the channel between deployed and retracted positions, wherein the engagement feature includes a slider at least partially positioned above the channel and an engagement member positioned below the channel, and further wherein the slider includes first and second opposed spring fingers configured to engage select retention members of the plurality of retention members along the opposed sides of the channel, respectively.

10. The cover device of claim 9, wherein the engagement member includes a deformable head portion.

11. The cover device of claim 9, including:

a locking mechanism operable between locked and unlocked positions, wherein the locking mechanism allows the engagement feature to move along the channel in the unlocked position, and further wherein the locking mechanism locks the first and second opposed spring fingers of the slider in engagement with the select retention members of the plurality of retention members to lock the engagement feature in a select position along the channel when the locking mechanism is in the locked position.

12. The cover device of claim 9, including:

a seal member operably coupled to the inner surface of the cover plate and extending downwardly therefrom.

13. The cover device of claim 9, including:

a punch-out member disposed along the cover plate and having a body portion surrounded by a perforated portion, wherein the perforated portion includes relief portions disposed along the body portion of the cover plate.

14. A cover device, comprising:

a cover plate having a body portion with inner and outer surfaces and first and second elongated channels disposed therethrough, wherein the first and second elongated channels each include a plurality of inward recesses disposed therealong;

a first engagement feature slidably disposed within the first elongated channel between first and second positions, wherein the first engagement feature includes first and second protrusions outwardly disposed in opposed directions;

a second engagement feature slidably disposed within the second elongated channel between first and second positions, wherein the second engagement feature includes first and second protrusions outwardly disposed in opposed directions;

a first locking mechanism disposed on the first engagement feature and slideable between locked and unlocked positions, wherein the first locking mechanism allows the first engagement feature to move along the first elongated channel when the first locking mechanism is in the unlocked position, and further wherein the first locking mechanism engages the first and second protrusions of the first engagement feature in engagement with the inward recesses of the first elongated channel when the first locking mechanism is in the locked position; and a second locking mechanism disposed on the second engagement feature and slideable between locked and unlocked positions, wherein the second locking mechanism allows the second engagement feature to move along the second elongated channel when the second locking mechanism is in the unlocked position, and further wherein the second locking mechanism engages the first and second protrusions of the second engagement feature in engagement with the inward recesses of the second elongated channel when the second locking mechanism is in the locked position.

15. The cover device of claim 14, including:

a punch-out section disposed along the cover plate and having a body portion with a perforated portion disposed along at least a portion of an outer perimeter of the body portion, wherein the perforated portion includes relief portions disposed along the body portion of the cover plate.

16. The cover device of claim 14, wherein the first and second engagement features further includes one or more spring fingers disposed below the inner surface of the cover plate.

* * * * *